US005958639A

United States Patent [19]

Kawase

[11] Patent Number: 5,958,639

[45] **Date of Patent: *Sep. 28, 1999**

[54] TONER FOR DEVELOPING LATENT ELECTROSTATIC IMAGES

[75] Inventor: Hiromitsu Kawase, Mishima, Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/729,076

[22] Filed: Oct. 10, 1996

Related U.S. Application Data

[63] Continuation of application No. 08/258,560, Jun. 10, 1994, abandoned.

[30] Foreign Application Priority Data

| | | | |
|---|---|---|---|
| Jun. 11, 1993 | [JP] | Japan | 5-166472 |
| Oct. 4, 1993 | [JP] | Japan | 5-271359 |
| Jun. 10, 1994 | [JP] | Japan | 6-152784 |

[51] Int. Cl.[6] ..... G03G 9/087

[52] U.S. Cl. ..... 430/109; 430/110; 430/111

[58] Field of Search ..... 430/109, 110, 430/111

[56] References Cited

U.S. PATENT DOCUMENTS

| | | | |
|---|---|---|---|
| 5,346,792 | 9/1994 | Kobayashi et al. | 430/109 |
| 5,350,657 | 9/1994 | Anno et al. | 430/109 |
| 5,356,747 | 10/1994 | Uno et al. | 430/109 |
| 5,368,968 | 11/1994 | Wehrmann et al. | 430/109 |
| 5,389,484 | 2/1995 | Hagiwara et al. | 430/109 |
| 5,391,695 | 2/1995 | Kawabe et al. | 430/109 |

*Primary Examiner*—Hoa Van Le
*Attorney, Agent, or Firm*—Cooper & Dunham LLP

[57] ABSTRACT

A toner having toner particles for developing latent electrostatic images, each toner particle containing a binder resin and a coloring agent, tho binder resin including a vinyl polymer prepared by polymerizing a plurality of different vinyl monomers, with a weight-average molecular weight (Mw) of 30,000 or less, and a peak molecular weight (PMw) of 10,000 or less in the weight-average molecular weight (Mw), with the amount ratio of a vinyl polymer with a molecular weight of not less than the value of PMw×10 being in the range of 1 to 30 wt. % of the entire amount of the vinyl polymer.

2 Claims, 2 Drawing Sheets

TONER FOR DEVELOPING LATENT ELECTROSTATIC IMAGES

This is a continuation of application Ser. No. 08/258,560, filed Jun. 10, 1994 (now abandoned).

BACKGROUND OF THE INVENTION

1. Field of the Invention

The present invention relates to a toner for developing latent electrostatic images in the field of electrophotography, electrostatic recording or electrostatic printing.

2. Discussion of Background

In the electrophotographic process and electrostatic recording or printing process, a latent electrostatic image in formed on a latent-electrostatic-image bearing member such an a photoconductor or a dielectric material and developed into a visible toner image with a toner which comprises toner particles pulverized to an appropriate particle size.

For the above-mentioned development, the toner in formed into a thin toner layer by a regulating member such as a blade on a toner-supply-roller such as a development sleeve, and charged to a predetermined polarity in a development unit. The electrostatic images formed on the latent-electrostatic-image bearing member are developed into visible toner images. The toner images thus obtained are then transferred to an image-receiving medium such as a sheet of paper or a plastic film when necessary.

The transferred toner images are then fixed on the image-receiving medium, for instance, with the application of heat and/or pressure thereto, or by the application of a solvent vapor thereto. Toner-image-bearing copies are thus obtained.

In recent years, in accordance with the remarkable development of office automation, the demand for easy and speedy color image copying is increasing, particularly color image copying which is capable of providing colored copy images faithful to the original color images just like printed color images. In order to most this demand, it is required to produce toner particles which have a small particle diameter and a low melt viscosity and are capable of being fixed on the image-receiving medium at low temperatures.

Conventionally, a toner for use in an electrophotographic developer is prepared by kneading a mixture of a binder resin, a coloring agent, a charge controlling agent, a fluidity-imparting agent and a grinding assistant, pulverizing the kneaded mixture to obtain finely-divided particles, and classifying the finely-divided particles. This method is hereinafter referred to as a pulverizing method. Other methods such as a polymerization method are also employed to obtain toner particle.

Various kinds of toner particles are prepared by the pulverizing method, an disclosed in Japanese Laid-Open Patent Applications 60-263951, 61-240252, 3-94269 and 4-127164. The toners obtained by this method comprise as the binder resin component a resin with a low softening point, such as polyester resin, polyol resin or epoxy resin, which is used alone or in combination with a styrene-based resin in order to achieve the image-fixing at low temperature. When the above-mentioned toners are used, however, the problems of a so-called off-set phenomenon by which fixed toner images are thermally transferred back to members other than the image receiving medium and the curling of fixed toner images tend to occur. These are serious problems in the copy making process.

On the other hand, when toner particles are prepared by the polymerization method, as disclosed in Japanese Laid-Open Patent Applications 59-218460 and 61-46955, a large quantity of wax can be added to polymerizable monomers during the polymerization thereof for producing binder resin particles, whereby the occurrence of the off-set phenomenon can be efficiently prevented, but the image-fixing at low temperature is hindered.

The toner prepared by the pulverizing method is susceptible to the ambient temperature and humidity. More specifically, at low humidities, the charge quantity of the toner is excessively increased, while at high humidities, the charge quantity of the toner becomes insufficient for use in practice.

In the case of the toner prepared by the polymerization method, a large quantity of a charge controlling agent and other agents can be contained in the polymerizable monomers, so that the environmental stability of the charging characteristics of the toner can be controlled to a certain extent. However, it is difficult to sufficiently disperse the charge controlling agent on the surface of the toner particles, so that there in also the problem that the charge quantity of the toner becomes excessive at low humidities and insufficient at high humidities.

Theme conventional toners prepared by the pulverizing method and polymerization method cannot always be provided with the desired charge quantity in a stable manner under various environmental conditions.

In addition, it has been proposed to decrease the molecular weight of a binder resin for use in a color toner in order to attain the image fixing at low temperature and to decrease the melt viscosity of the toner, as disclosed in Japanese Laid-Open Patent Applications 53-96839, 60-244956, 60-252363, 61-117564, 61-123954, 61-200549, 62-9356, 1-201672 and 3-185458. However, when the toners proposed in these applications are used, the problems of insufficient gloss and curling of the obtained toner images remain unsolved.

Most toners currently employed, especially color toners, are still not satisfactory in the above-mentioned respects.

SUMMARY OF THE INVENTION

Accordingly, a first object of the present invention in to provide a toner, especially a color toner, for developing latent electrostatic images, which can produce sharp and clear images with an appropriate glossiness, with a minimized curling problem in the fixed toner images obtained by the toner.

A second object of the present invention is to provide a toner, especially a color toner, which can be fixed on an image-receiving medium at low temperature and has excellent charging characteristics which are not susceptible to the changes in the environmental conditions such as temperature and humidity.

The above-mentioned objects of the present invention can be achieved by a toner which comprises toner particles, each toner particle comprising a binder resin and a coloring agent, the binder resin comprising a vinyl polymer prepared by polymerizing a plurality of different vinyl monomers, with a weight-average molecular weight (Mw) of 30,000 or less, and a peak molecular weight (PMw) of 10,000 or less in the weight-average molecular weight (Mw), with the amount ratio of a vinyl polymer with a molecular weight of not less than the value of $\alpha$ represented by formula (1) being in the range of 1 to 30 wt. % of the entire amount of the vinyl polymer:

$$\alpha = PMw \times 10 \quad (1).$$

Part of the above-mentioned vinyl monomers may be at least one of a vinyl monomer of formula (1) or a vinyl monomer of formula (II):

(I)

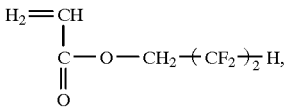

(II)

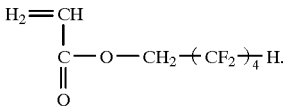

Furthermore, part of the above-mentioned vinyl monomers may be an ionic monomer to which part of a fluorine-containing compound of formula (III) is chemically bonded at the surface of the toner particles:

(III)

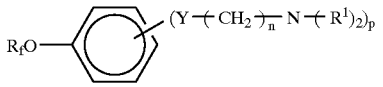

wherein $R_f$ is a straight or branched perfluoroalkyl group or perfluoroalkenyl group having 2 to 9 carbon atoms; Y is —CONH—, —$SO_2$NH—, or —COO—; $R^1$ in an alkyl group having 2 to 10 carbon atoms; n in an integer of 2 to 10; and p is an integer of 1 or 2, provided that when p is 2, n may be the same or different.

The above-mentioned ionic monomer may be an anionic monomer of formula (IV):

(IV)

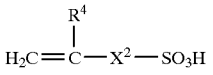

wherein $R^4$ in —H or —$CH_3$; and $X^2$ is an atomic group comprising at least one atom selected from the group consisting of C, O and H.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
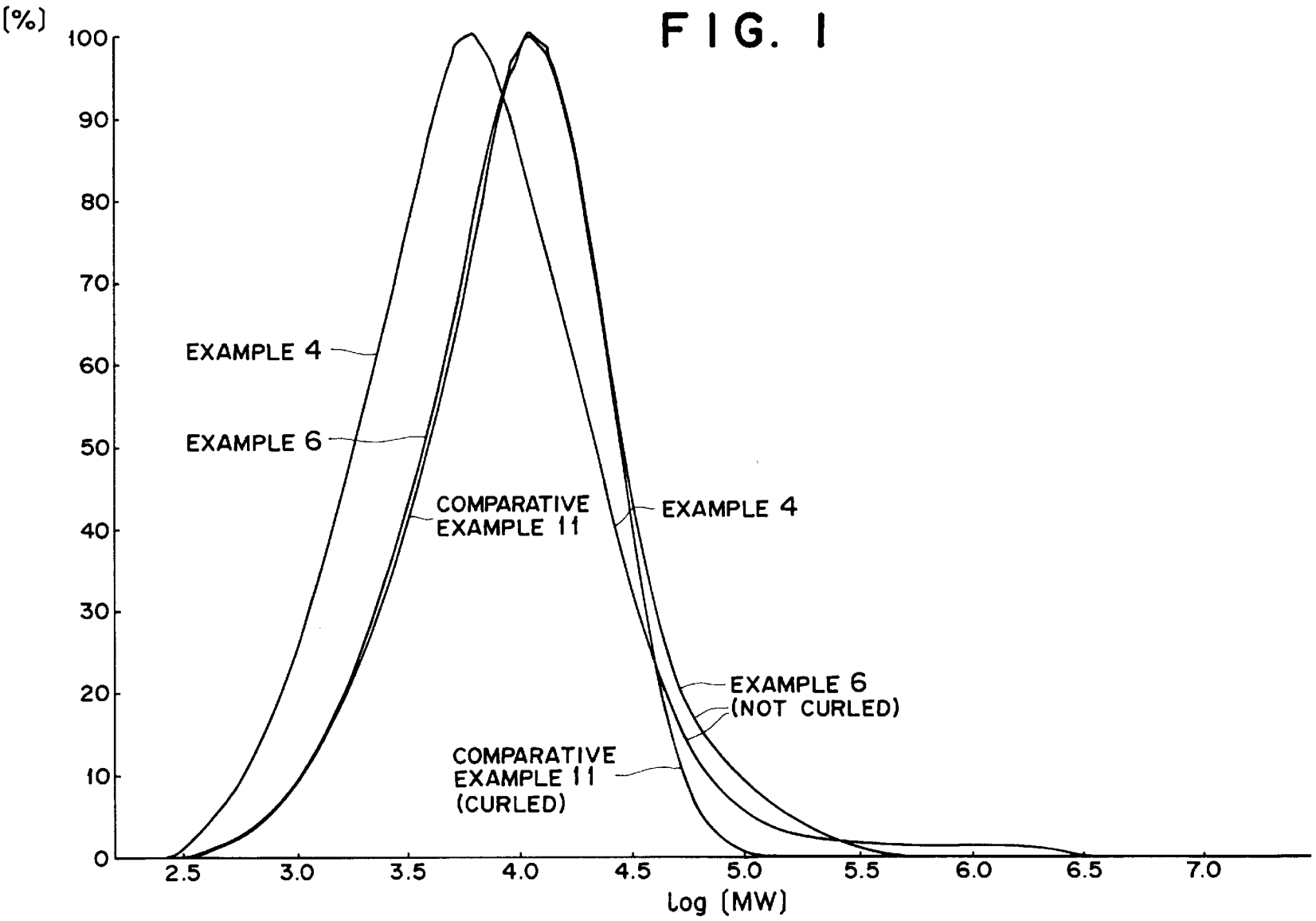
FIG. 1 is a graph which shows the molecular weight distributions of the resins for use in the present invention and the molecular weight distribution of a resin for use in a comparative toner.

The toner of the present invention can be produced, for example, by any of the following methods:

(1) A method of kneading polymers with different molecular weight distributions together with a coloring agent under the application of heat thereto, and pulverizing and dispersing the mixture, thereby obtaining the toner of the present invention.

(2) A method of preparing polymer particles with a desired particle diameter (binder resin particles) by dispersion polymerization, and then dyeing the polymer particles, thereby obtaining the toner of the present invention.

(3) A method of preparing polymer particles with a desired particle diameter by dispersion polymerization, dyeing the polymer particles, and coating the surface of the dyed particles with a fluorine-containing compound by chemical bonding, thereby obtaining the toner of the present invention.

When the above-mentioned method (1), a pigment is added to a mixture of a vinyl polymer (hereinafter referred to as thermoplastic resin A) with a weight-average molecular weight of about 20,000 to 50,000 and a vinyl polymer (hereinafter referred to an thermoplastic resin B) which is highly crosslinked to the thermoplastic resin A and contains components insoluble in tetrahydrofuran (THF). The thus prepared mixture is kneaded with the addition of a charge controlling agent, and when necessary, with the addition of a magnetic powder as well.

In this came, the amount ratio of the thermoplastic resin (A) to the thermoplastic resin (B) is determined in such a manner that the weight-average molecular weight (Mw) of the binder resin component, namely, the entire vinyl polymers, is 30,000 or less and the peak molecular weight (PMw) in the weight-average molecular weight distribution is 10,000 or less by adjusting the molecular weight distribution of the toner by controlling the mechanical strength and shear force applied to the mixture when kneaded, whereby fixed toner images with an appropriate glossiness, which is particularly necessary for color images, can be obtained. When the thermal energy and shear force applied to the mixture in the kneading process are insufficient, and/or when the amount of the thermoplastic resin B exceeds about 40 wt. % of the total amount of the thermoplastic resin A and the thermoplastic resin B, the molecular weight of the binder resin component of the toner is extremely increased, so that the obtained toner image lacks the gloss, and appears poor in quality.

In addition, when the amount ratio of a vinyl polymer with a molecular weight of 10 or more times the peak molecular weight (PMw) of the vinyl polymers, that is, a molecular weight of not less than the value of $\alpha$ represented by formula ($\alpha$=PMw×10) is in the range of 1 to 30 wt. %, preferably in the range of 15 to 30 wt. %, of the entire amount of the binder resin for the toner, the occurrence of the curling of fixed images can be substantially prevented.

When the toner of the present invention is prepared by the previously mentioned method (1), the following coloring agents, charge controlling agents, and magnetic powders can be employed:

Coloring agents: carbon black, iron oxide pigment, quinacridone, monoazo compounds, bisazo compounds, perylene, Naphthol, and copper phthalocyanine.

Charge controlling agents: Nigrosine dye, metal-containing dyes, fatty acid asters, chromium malt of 3,5-di-tert-butylsalicylic acid, and fluorine-containing compounds.

Magnetic powders: finely-divided particles of metals such as iron, manganese, nickel and cobalt; and finely-divided particles of iron, and ferrites containing manganese, nickel, cobalt or zinc.

When the toner of the present invention is prepared by the method (1), at least one of the fluorine-containing compound of formula (I) or the fluorine-containing compound of formula (II) is used as part of the vinyl monomers for synthesizing the vinyl polymer, whereby a toner with the fluorine atoms being present at the surface layer of the toner particles thereof can be obtained:

(I)

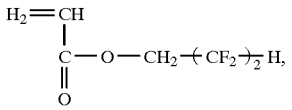

(II)

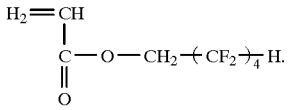

In the method (1), it is preferable to employ resin particles prepared by the following dispersion polymerization method. More specifically, vinyl polymer particles (binder resin particles (C)) and a coloring agent are dispersed and kneaded to prepare a colored resin (D). 80 parts by weigh of the thus prepared colored resin (D) and 100 parts by weight of the binder resin particles (C) are kneaded, with the addition of a charge controlling agent thereto. This mixture in then pulverized, whereby a color toner with excellent pulverizing performance can be obtained.

In the previously mentioned method (2), a polymeric dispersion stabilizer is dissolved in a hydrophilic organic liquid. Then, at least one kind of monomer which is soluble in the above-mentioned organic liquid, but a polymer prepared from which swells or is scarcely soluble in the organic liquid, is polymerized in the organic liquid to prepare polymer particles. The thus obtained polymer particles are dyed, whereby a toner according to the present invention, which is capable of providing toner images with proper gloss and does not cause the curling problem, can be obtained.

The toner coated with a fluorine-containing compound, prepared in the previously mentioned method (3), can be prepared by coating the surface of the polymer particles prepared by the method (2) with a fluorine-containing compound of the previously mentioned formula (III), whereby there can be obtained a toner which is capable of producing toner images with appropriate glossiness, free from the problem of the curling of fixed toner images, and stable to the changes in the ambient conditions such as temperature and humidity.

Examples of the fluorine-containing compound of formula (III) are shown below, each can be prepared in accordance with the following reaction scheme, an described in "Corrosion Control" '79-7, p. 11–22:

(a)

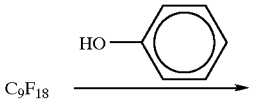

-continued

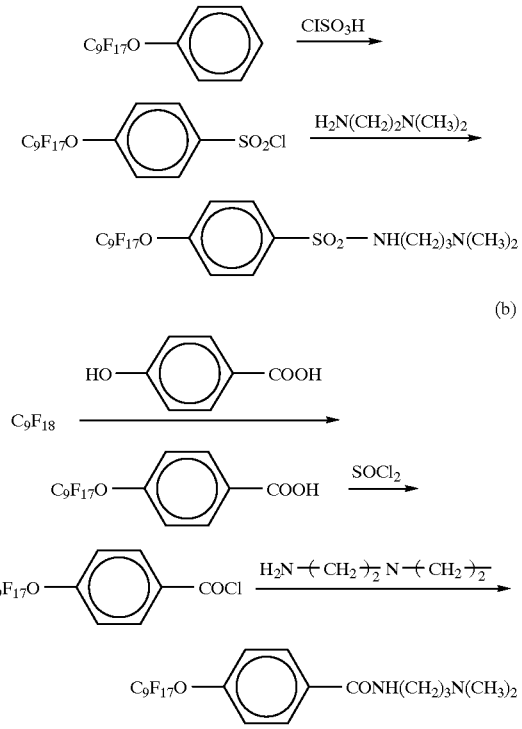

(b)

The preparation of the vinyl polymer particles for use in the binder resin component by the dispersion polymerization method will now be described in more detail specifically with reference to the following steps:

(i) Precipitation of seed particles

A predetermined amount of a polymerization initiator (hereinafter referred to as the initiator) is dissolved in methanol to prepare a solution. This initiator is in an amount of 1/100 mole to one mole of the entire monomers to be polymerized.

A 1/1000 volume of this solution is added to a polymerization system by a microsyringe to precipitate seed particles in a stable condition from the polymerization system.

(ii) Initiation of polymerization

The polymerization system changes from a transparent state to a white opaque state in about 10 minutes with the separation of the seed particles. In about 35 to 40 minutes, the remaining 999/1000 volume of the initiator is added as the main initiator to the initially added monomers to be polymerized in the polymerization system, whereby the seed particles are caused to grow further.

The particle size of the polymer particles can be controlled by the addition of a chain transfer agent to the polymerization system. For example, when polymer particles with a diameter of about 5 μm are obtained from a mixture of 55 parts by weight of styrene and 45 parts by weight of methyl acrylate by use of methanol as the solvent for the polymerization in an amount of 250 parts by weight to 100 parts by weight of the above-mentioned monomer mixture, the amount of a chain transfer agent is 0.25 wt. % of the entire amount of this polymerization system, whereby uniformly dispersed polymer particles with a particle size of about 5 μm can be obtained.

The particle size of the uniformly dispersed binder resin particles for use in the present invention is in the range of about 3 μm to about 13 μm, which can be obtained by adjusting the amount of the chain transfer agent to be added to the polymerization system.

(iii) Further addition of the chain transfer agent

It is desirable to further add the chain transfer agent to the polymerization system at the initial stage of polymerization when a large amount of monomers still remains in the polymerization system. The effects of the chain transfer agent to be further added to the polymerization system at the initial stage of the polymerization are as follows:

(a) The chain transfer agent added at the initial stage of polymerization moves radical points formed from a polyfunctional monomer serving as a crosslinking agent, whereby the generation of crosslinking points is hindered. Thus, a graft polymer with a high molecular weight is formed.

(b) In the same manner as mentioned above, the chain transfer agent added at the initial stage of polymerization terminates the generation of the radical points in the growing polymer, whereby the molecular weight of the resulting polymer is caused to remain low.

In the case where the radical points generated from a polyfunctional monomer by use of a chain transfer agent when initiating the polymerization are moved by the polyfunctional monomer, thereby hindering the generation of the crosslinking points, the amount of the chain transfer agent and the timing of the addition of the chain transfer agent are very important factors for the preparation of binder polymer particles. The chain transfer agent may be added in an amount equimolar or more to the amount of the polyfunctional monomer, preferably in an amount of at least two times the amount of the polyfunctional monomer in terms of molar amount.

It is preferable that the chain transfer agent be added to the polymerization system before the conversion of polymerization reaches 30%. When the chain transfer agent is added to the polymerization system after the conversion of polymerization exceeds 30%, even though the generation of the crosslinking points is prevented thereafter to any extent, the thermal fixing properties of the obtained polymer particles are very poor, which means the thermal energy required for fixing toner images on an image-receiving medium is increased. Therefore, such polymer particles are not suitable for a binder resin for color toner.

A most desirable method is to add the chain transfer agent and the main initiator to the polymerization system at the same time as long as such simultaneous addition of the two does not have any adverse effects on the particle size distribution of the obtained polymer particles.

In accordance with the method of adding a chain transfer agent to the polymerization system before the conversion of polymerization reaches 30%, the molecular weight of the resulting polymer particles for the binder resin can be maintained low for sure, so that the obtained binder resin particles can be thermally fixed at low temperature, and proper glossiness can be imparted to the fixed toner images when such polymer particles are used.

(iv) Further addition of the monomers and initiator at the latter stage of polymerization To further increase the conversion of polymerization at the latter stage of polymerization, monomers such an styrene monomer are added to the polymerization system, and when necessary, an ionic monomer, a crosslinking agent (a polyfunctional monomer) and a fluorine-containing compound monomer may also be added thereto. The timing for such addition of these components is when the conversion of polymerization reaches about 60 to 80%. The amount of the monomers to be added at the latter stage of polymerization is preferably about 20 parts by weight to 100 parts by weight of the monomers initially placed in the polymerization system.

The amount of an initiator to be added immediately after the further addition of the monomers has a significant effect on the thermal properties of the polymer particles to be obtained. In order to obtain polymer particles having the same thermal properties as those of the polymer particles obtained at the conversion of polymerization of about 60 to 80%, it is preferable that the amount of the initiator to be added for the monomers added at the latter stage of polymerization be an equimolar amount or more with respect to the amount of the main initiator, more preferably, a 1/100 molar amount or more with respect to the amount of the monomers which still remain in a dissolved state in the polymerization system. From the viewpoint of curtailment of the time required for the polymerization, it is desirable to add the initiator to the polymerization system when the conversion of polymerization reaches 65 to 70%.

In the case where the crosslinking agent (the polyfunctional monomer) is further added to the polymerization system at the latter stage of polymerization, the polyfunctional monomer, which may be used alone or in combination with styrene, is diluted with a solvent such as methanol, and the thus prepared solution of the polyfunctional monomer is added to the polymerization system when the conversion of polymerisation reaches about 60 to 80%. The amount of the crosslinking agent, which varies depending on the kind of crosslinking agent to be employed, is preferably about 10 parts by weight or less to 100 parts by weight of the monomers to be added to the polymerization system at the latter stage of polymerization. When the amount of the crosslinking agent is within the above range, the polymerization proceeds stably without forming agglomerates.

At the latter stage of polymerization, it is also preferable to add a fluorine-containing compound monomer to the polymerization system. The amount of the fluorine-containing compound monomer is preferably in the range from 5 to 20 parts by weight to 100 parts by weight of other monomers constituting the polymer particles. When the amount of the fluorine-containing compound monomer is 5 parts by weight or more in the above, the environmental stability of the charging characteristics of the toner obtained is remarkably improved, but preferably not more than 20 parts by weight from the view point of the stability of the production of the polymer particles.

In the case where an ionic monomer is also added at the latter stage of polymerization, the ionic monomer, which may be used alone or in combination with styrene, is diluted with a solvent such an methanol, and the solution of the ionic monomer is added to the polymerization system when the conversion of polymerization reaches about 60 to 80% in the same manner as in the case of the addition of the crosslinking agent which is the polyfunctional monomer.

In the case of the addition of the ionic monomer, it is preferable that the temperature of the polymerization system be lowered to room temperature before the ionic monomer is added thereto. The amount of the ionic monomer to be added can be about 20 wt. % or less of the entire amount of the monomers in the polymerization system from the viewpoint of the control of the charging characteristics of the toner to be obtained. However, when the amount of the ionic monomer is excessive, polymers soluble in a hydrophilic organic solvent such as methanol may be formed, so that it is preferable that the amount of the ionic monomer be in the range of 0.1 wt. % to 10 wt. % of the entire amount of the monomers in the polymerization system.

The ionic monomer for use in the present invention may be, for instance, the following anionic monomer:

Anionic monomer of the following formula (IV):

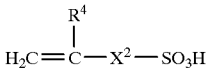

(IV)

wherein $R^4$ in —H or —$CH_3$; $X^2$ is an atomic group comprising at least one atom selected from the group consisting of C, O and H.

Examples of the above-mentioned atomic group are —$(CH_2)_m$— wherein m=2–10; a benzene ring; and

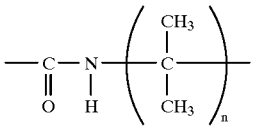

wherein n=1–10.

Specific examples of the above-mentioned anionic monomer are tert-butylacrylamide sulfonic acid and paratoluenesulfonic acid, but the above anionic monomer is not limited to these examples.

An previously mentioned, the binder resin component for use in the toner of the present invention comprises polymer particles obtained by polymerizing vinyl monomers, with the weight-average molecular weight (Mw) of the polymer particles being 30,000 or loom, the peak molecular weight (PMw) in the weight-average molecular weight distribution of the polymer particles being 10,000 or less, and with the amount ratio of a vinyl polymer with a molecular weight of not less than the value of α represented by formula (1) being in the range of 1 to 30 wt. % of the entire amount of the vinyl polymer:

$$\alpha = PMw \times 10 \quad (1).$$

In the toner according to the present invention, the polymer particles for the binder resin component comprises (a) a low-molecular polymer serving to impart the proper glossiness to fixed toner images, and (b) a high-molecular graft polymer with a molecular weight which is 10 to 100 times that of the above-mentioned low-molecular polymer. The high-molecular graft polymer decreases the glossiness of fixed toner images. However, in the present invention, the amount ratio of the low-molecular polymer to the high-molecular graft polymer is well-balanced in the binder resin component, so that the fixed toner images are provided with proper glossiness and are almost free from the problem of the curling of fixed toner image.

It is understood that the above-mentioned advantages result from the following mechanism:

The binder resin particles for use in the toner contain the high-molecular graft polymer and the low-molecular polymer having a weight-average molecular weight which is extremely lower than that of the high-molecular graft polymer, with different volume change time constants, so that these polymers with different weight-average molecular weights interact at the thermal expansion and contraction with changes in the respective volumes at the image fixing process, resulting in that almost no thermal expansion and contraction takes place in the binder resin after the image-fixing process.

In the above-mentioned interaction, the styrene blocks in the high-molecular graft polymer and the styrene blocks in the low-molecular polymer, or the methyl acrylate blocks in the high-molecular graft polymer and the methyl acrylate blocks in the low-molecular polymer are gathered, with the graft polymer serving as an axis for the gathering, to cause self-aggregation when the resin particles are thermally plasticized in the image-fixing process. As a result, the self-aggregation force is generated in the resin particles, and the elasticity is also generated against the thermal expansion and contraction. Therefore, the changes in the volume of the resin particles can be minimized, thereby preventing the curling of the fixed toner images.

FIG. 1 is a graph which shown the molecular weight distributions of the resins for use in the present invention and the molecular weight distribution of a resin for use in a comparative toner.

The weight-average molecular weight of each of these binder resins was measured by gel permeation chromatography by using a commercially available measuring instrument "LC100" (Trademark) made by Yokogawa Electric Corporation. In the measurement, each sample binder resin was dissolved in tetrahydrofuran (THF) at a concentration of 0.1 wt. %. With the thus obtained solution being introduced into the measuring instrument at a flow rate of 1 ml/min at 20° C., the molecular weight of each binder rosin was determined by use of a calibration curve with reference to mono-dispersed polystyrene reference samples.

The conversion of polymerisation can be measured by taking out a sample of the polymer from the polymerization system in the course of the polymerization reaction, subjecting the sample to gas chromatography, and determining the conversion of polymerization by an internal standard method. Alternatively, a sample of the polymer is taken out of the polymerization system during the polymerization reaction, and is then completely dried. The polymerization conversion of the sample is obtained by dividing the weight of the solid content of the sample by the total weight of the monomers used so far, which includes the weight of the monomers added in the latter stage of polymerization. In this case, it is necessary to subtract the weight of a solid content of the dispersion stabilizer from the weight of the solid content of the sample.

Materials used when producing binder resin particles for use in the present invention will now be explained.

Specific examples of the dispersion stabilizer which is used to cause the seed particles to separate out and grow are as follows: acids such an acrylic acid, methacrylic acid, α-cyanoacrylic acid, α-cyanomethacrylic acid, itaconic acid, crotonic acid, fumaric acid, and maleic acid or maleic anhydride; acrylic monomer having hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid muter, glycerol monoacrylic acid ester, glycerol monomethacrylic acid ester, N-methylolacrylamide, and N-methylolmethacrylamide; vinyl alcohol and ethers thereof such as vinylmethyl ether, vinylethyl ether, and vinylpropyl ether; esters of vinyl alcohol and carboxyl-group-containing compound, such as vinyl acetate, vinyl propionate, and vinyl butyrate; acrylamide, methacrylamide, diacetonacrylamide, and methylol compounds thereof; acid chlorides such as chlorides of acrylic acid and methacrylic acid; homopolymers or copolymers comprising nitrogen or a heterocyclic group containing nitrogen, such as vinyl pyridine, vinyl pyrrolidone, vinyl imidazole, and ethyleneimine; polyoxyothylone, polyoxypropylene, polyoxyethylene alkylamine, polyoxypropylene alkylamine, polyoxyethylene alkylamide, polyoxypropylene alkylamide, polyoxyethylene laurylphenyl ether, polyoxyethylene stearylphenyl ether and polyoxyethylene nonylphenyl ether; cellulose such as methyl cellulose, hydroxyethyl cellulose, and hydroxypropyl cellulose; and copolymers of the above-mentioned hydrophilic monomer and a monomer containing a benzene nucleus or derivatives thereof, such as styrene, α-methylstyrene or vinyltoluene, copolymers of the above-mentioned hydrophilic monomer and an acrylic or methacrylic acid derivatives, such as acrylonitrile, methacrylonitrile or acrylamide, and copolymers of the above-mentioned hydrophilic monomer and a cross-linkable monomer, such as ethylene glycol dimethacrylate, diethylene glycol dimethacrylate, allyl methacrylate, or divinylbenzene.

An appropriate dispersion stabilizer may be selected from the above dispersion stabilizers depending upon the kind of hydrophilic organic liquid employed, and also depending upon its use for the production of seed particles or for the further growing of seed particles.

In particular, in order to sterically prevent the aggregation of the resulting polymer particles, it is preferable that the dispersion stabilizer have not only high affinity and adsorptivity for the surface of the polymer particles, but also high affinity for the hydrophilic organic liquid and high solubility therein.

Furthermore, in order to increase the repulsion between the polymer particles, it in preferable that the main molecular chain of the dispersion stabilizer be relatively long, more specifically, the molecular weight thereof be 10,000 or more. However, when the molecular weight of the dispersion stabilizer is excessively high, the viscosity of the liquid used for the polymerization becomes extremely high, so that the operating efficiency is lowered, with the stirring thereof becoming difficult. The result is that the probability of the deposition of the formed polymer on the surface of the polymer particles tends to be scattered and becomes non-uniform. Therefore, care must be taken in this respect.

In combination with the polymeric dispersion stabilizer, finely-divided particles of metals, preferably with a particle diameter of 1 μm or less, such as cobalt, iron, nickel, aluminum, copper, tin, lead and magnesium and alloys thereof, and oxides such an iron oxide, copper oxide, nickel oxide, zinc oxide, titanium oxide and silicon oxide; and finely-divided particles of surface active agents can be employed to improve the stability and the particle diameter distribution of the resulting polymer particle.

Examples of the above-mentioned surface active agent are as follows:

1. Anionic surface active agents: a salt of sulfate of higher alcohol, a salt of alkylbenzensulfonic acid, a salt of α-olefin sulfonic acid and a phosphoric ester.

2. Cationic surface active agents: an amine salt such as an alkylamine salt, an aminoalcohol fatty acid derivative, a polyamine fatty acid derivative and imidazoline, and a quaternary ammonium salt such as alkyl trimethylammonium salt, dialkyl dimethylammonium salt, alkyl dimethylammonium salt, pyridium salt, alkyl isoquinolinium salt, and benzethonium chloride.

3. Nonionic surface active agent: a fatty amide derivative, and polyhydric alcohol derivative.

The above-mentioned surface active agents may be used in combination with an ampholytic surface active agent such as an amino-acid ampholytic surface active agent, for example, dodecyl di(aminoethyl)glycine and di(octylaminoethyl)glycine and a betaine ampholytic surface active agent.

The amount of the polymeric dispersion stabilizer used in the preparation of the seed particles, which varies depending upon the kind of polymerizable monomer for use in the desired polymer particles, is preferably in the range of 0.1 to 10 parts by weight, and more preferably in the range of 1 to 5 parts by weight, to 100 parts by weight of the hydrophilic organic liquid. When the concentration of the polymeric dispersion stabilizer is low, polymer particles with a relatively large particle diameter are produced. On the other hand, polymer particles with a small particle diameter can be obtained when the concentration of the polymeric dispersion stabilizer is high. Even though more than 10 parts by weight of the polymer dispersion stabilizer is employed, it is not effective to decrease the particle diameter of the obtained polymer particles.

Examples of the vinyl monomer subjected to polymerization, which can be dissolved in the hydrophilic organic liquid, include styrene and styrene derivatives such as o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, and 3,4-dichlorostyrene; acrylic acid derivatives and methacrylic acid derivatives such an methyl acrylate, ethyl acrylate, butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate, diethylaminoethyl methacrylate, acrylonitrile, methacrylonitrile and acrylamide; and halogenated vinyl compounds such as vinyl chloride, vinylidene chloride, vinyl bromide, and vinyl fluoride.

These monomers can be used alone or in combination with each other. Alternatively, the above-mentioned monomers can be used in combination with other monomers capable of forming a copolymer.

Examples of the hydrophilic organic liquid used for the polymerization include alcohol such as methyl alcohol, ethyl alcohol, modified-ethyl alcohol, isopropyl alcohol, n-butyl alcohol, isobutyl alcohol, tert-butyl alcohol, sec-butyl alcohol, tert-amyl alcohol, 3-pentanol, octyl alcohol, benzyl alcohol, cyclohexanol, furfuryl alcohol, tetrahydrofurfuryl alcohol, ethylene glycol, glycerin, and diethylene glycol; and ether alcohols such as methyl cellosolve, Cellosolve solvent, isopropyl cellosolve, butyl cellosolve, ethylene glycol monomethyl other, ethylene glycol monoethyl ether, diethylene glycol monomethyl ether, and diethylene glycol monoethyl ether.

These hydrophilic organic liquids can be used alone or in combination. In addition, the above-mentioned alcohols or ether alcohols can be used in combination with other organic liquids to prepare a dispersion medium. In this case, it is possible to change the solubility parameter (SP) of the employed-dispersion medium provided that the above-mentioned organic liquids used with the alcohols or ether alcohols do not dissolve the resulting polymer particles therein. As a result, the polymerization conditions can be controlled so as to adjust the particle diameter of the resulting polymer particles and prevent the coalescence of the seed particles.

Examples of the above-mentioned organic liquid which can be used in combination with the alcohols or other alcohols are as follows: hydrocarbons such as hexane, octane, petroleum other, cyclohexane, benzene, toluene, and xylene; halogenated hydrocarbons, such as carbon tetrachloride, trichloroethylene, and tetrabromoethane; ethers such as ethyl ether, dimethyl glycol, trioxane, and tetrahydrofuran; acetals such an methylal, and diethyl acetal; ketones much an acetone, methyl ethyl ketone, methyl isobutyl ketone, and cyclohexane; esters such as butyl formate, butyl acetate, ethyl propionate, and Cellosolve acetate; acids such as formic acid, acetic acid, and propionic acid; sulfur-containing organic compounds and nitrogen-containing organic compounds such an nitropropene, nitrobenzene, dimethylamine, monoethanolamine, pyridine, dimethyl sulfoxide, and dimethylformamide; and water.

Examples of the polymerization initiator include azo polymerization initiators, such as 2,2'-azobisisobutyronitrile, and 2,2'-azobis(2,4-dimethylvaleronitrile; peroxide polymerization initiators such as lauryl peroxide, benzoyl peroxide and tert-butyl peroctoate; and persulfide polymerization initiators such as potassium persulfate. In addition, sodium thiosulfate and amine may be used in combination with the above-mentioned initiators.

In order to adjust the molecular weight of the polymer particles, the polymerization may be carried out in the presence of a compound with a large chain transfer constant as a chain transfer agent.

Examples of such a compound include a low molecular compound having a mercapto group, carbon tetrachloride, carbon tetrabromide, and mercaptans such as butyl mercaptan, octyl mercaptan, dodecyl mercaptan, methyl 2-mercaptopropionate, ethyl 2-mercaptopropionate, butyl 2-mercaptopropionate, octyl 2-mercaptopropionate, 2-mercaptopropionate, ethylene glycol di(2-mercaptopropionate), and glycerin tri(2-marcaptopropionate). The chain transfer agent for use in the present invention is not limited to the above-mentioned compounds.

Examples of the polyfunctional monomer having two or more polymerizable double bonds therein, namely, the crosslinking agent used in the polymerization, include aromatic divinyl compounds such an divinylbenzene, divinylnaphthalene, and derivatives thereof; diethylenic carboxylic acid esters such as ethylene glycol dimethacrylate, diethylene glycol methacrylate, triethylene glycol methacrylate, trimethylolpropane triacrylate, allyl methacrylate, tert-butylaminoethyl methacrylate, tatraethylene glycol methacrylate and 1,3-butanediol dimethacrylate; divinyl compounds such as N,N-divinyl aniline, divinyl ether, divinyl sulfide and divinyl sulfone; and other compounds having three or more vinyl groups. These compounds may be used alone or in combination.

The following commercially available polyfunctional monomers made by Osaka Organic Chemical Industry Ltd. are preferable in the present invention:

(1) NO. 195: $CH_2{=}CHCOO(CH_2)_4OCOCH{=}CH_2$ (2) NO. 310: $CH_2{=}CHCOO{-}(CH_2\underset{\underset{CH_3}{|}}{C}HO)_3COCH{=}CH_2$ (3) NO. 335: $CH_2{=}CHCOO{-}(CH_2CH_2O)_4COCH{=}CH_2$ -continued (4) NO. 110:

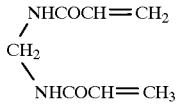

(5) NO. 2711:

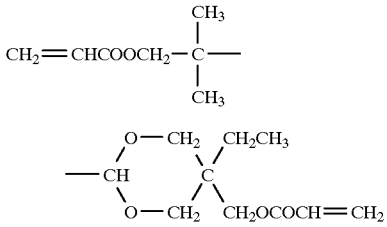

(6) NO. 2112:

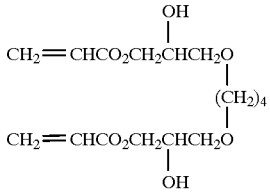

Using the thus obtained binder resin particles, a color toner according to the present invention can be prepared by the following method: the resin particles are dispersed in an organic solvent (hereinafter referred to as an organic solvent A) not dissolving the resin particles therein. Before or after the preparation of the dispersion of the rosin particles, a dye is dissolved in the organic solvent A, and the dye is caused to permeate through the rosin particles in their entirety. Thereafter the organic solvent A in distilled away, so that dyed toner particles can be obtained. In this case, it is preferable to select such a dye as can satisfy the relationship of $(D_1)/(D_2) \leqq 0.5$, wherein $(D_1)$ is a solubility of the dye in the above-mentioned organic liquid A and $(D_2)$ in a solubility of the dye in the resin particles. Furthermore, it is preferable that the ratio of $(D_1)/(D_2)$ be 0.2 or less. When the ratio of $(D_1)/(D_2)$ is within the above range, the toner particles can efficiently be manufactured in which the dye permeates through the resin particles in their entirety.

According to this method, the resin particles are dispersed in the organic solvent A in which the dye is previously dissolved, and the dispersion thus obtained may be stirred using a stirrer such as a homomixer or a magnetic stirrer, with the temperature of the dispersion being maintained at the glass transition temperature or less of the resin particles.

Alternatively, the dye may be added directly to a slurry of the resin particles obtained at the conclusion of the dispersion polymerization, and the slurry may be stirred at the glass transition temperature or loss of the resin particles so as not to cause the fusing of resin particle.

The dye used for dyeing the resin particles is not limited as long as the above-mentioned relationship between the two solubilities of the employed dye is satisfied. A vat dye, a disperse dye, and an oil-soluble dye are preferred to a water-soluble dye such as a cationic dye or an anionic dye because the environmental stability of the former dyes is superior, and the resistivity of the toner comprising the former dyes is not lowered, so that the image transferable ratio is not decreased in the image formation process. In particular, the oil-soluble dye is preferably employed in the present invention.

In addition, a plurality of dyes can be used in combination in accordance with a desired color tone of the toner image. The amount ratio by weight of the dye to the resin particles may be freely determined depending on the degree of pigmentation, and in general, it is preferable that the amount of the dye be 1 to 50 parts by weight to 100 parts by weight of the resin particles.

For instance, when an alcohol such as methanol or ethanol, which shows a high solubility parameter, is used as the organic solvent A and a styrene—acrylic resin with a solubility parameter of about 9 is used for the resin particles, the following dyes can be preferably employed:

C.I. Solvent Yellow (6, 9, 17, 31, 35, 100, 102, 103, 105),

C.I. Solvent Orange (2, 7, 13, 14, 66),

C.I. Solvent Red (5, 16, 17, 18, 19, 22, 23, 143, 145, 146, 149, 150, 151, 157, 158), C.I. Solvent Violet (31, 32, 33, 37), C.I. Solvent Blue (22, 63, 78, 83, 84, 85, 86, 91, 94, 95, 104), C.I. Solvent Green (24, 25), and C.I. Solvent Brown (3, 9).

In addition to the above, the following commercially available dyes can be employed:

Aizen Sot Yellow-1, 3, 4, Aizen Sot Orange-1, 2, 3, Aizen Sot Scarlet-1, Aizen Sot Red-1, 2, 3, Aizen Sot Brown-2, Aizen Sot Blue-1, 2. Aizen Sot Violet-1, Aizen Sot Green-1, 2, 3, and Aizen Sot Black-1, 4, 6, 8 (Trademark), made by Hodogaya Chemical Co., Ltd.; Sudan Yellow-140, 150, Sudan Orange-220, Sudan Red-290, 380, 460, and Sudan Blue-670 (Trademark), made by BASF Japan. Ltd.; Diaresin Yellow-3G, F, H2G, HG, HC, HL, Diaresin Orange-HS, G, Diaresin Red-GG, S, HS, A, K, H5B, Diaresin Violet-D, Diaresin Blue-J, G, Nt K, P, H3G, 4G, Diaresin Green-C, and Diaresin Brown-A (Trademark), made by Mitsubishi Chemical Industries, Ltd.; Oil Color Yellow-3G, GG-S, #105, Oil Color Orange-PS, PR, #201, Oil Color Scarlet-#308, Oil Color Red-5B, oil Color Brown-GR, #416, Oil Color Green-BG, #502, Oil Color Blue-BOS, HN, and Oil Color Black-HBE, #803, EE, EX (Trademark), made by Orient Chemical Industries, Ltd.; Sumiplast Blue GP, OR, Sumiplast Red FB, 3B, and Sumiplast Yellow FL7G, GC (Trademark), made by Sumitomo Chemical Co., Ltd.; Kayaron, Polyester Black EX-SH30, Kayaset Blue A-2R, and Kayaset Red-B (Trademark), made by Nippon Kayaku Co., Ltd.

As a matter of course, the dye for use in the present invention is not limited to the above because the dye can be appropriately selected in accordance with the combination of the resin particles and the organic solvent A.

For the organic solvent A in which the resin particles are dyed with the dye, an organic liquid in which the resin particles to be employed are not dissolved or slightly swell therein may be employed. More specifically, it is preferable that the difference between the solubility parameter of the resin particles and that of the organic liquid be 1.0 or more, and more preferably 2.0 or more. For example, methanol, ethanol and n-propanol with a high solubility parameter, or n-hexane and n-heptane with a low solubility parameter are preferably employed for the styrene—acrylic resin particles. When the difference in solubility parameter is extremely large, the wettability of the resin particles by the organic liquid in poor, so that the resin particles cannot be uniformly dispersed in the organic liquid. Therefore, the optimum difference between the two solubility parameters is in the range from about 2 to 5.

As the previously mentioned fluorine-containing compound of formula (III), a fluorine-containing compound of formula (III-1) and a fluorine-containing compound of formula (III-2) can be employed:

(III-1)

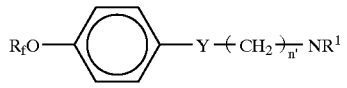

(III-2)

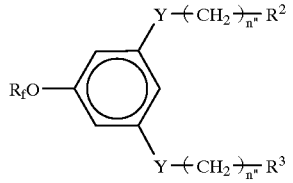

wherein $R_f$ is $HC_2F_2$—, $HC_3H_6$—, $HC_4H_8$—, $HC_3H_{10}$—, $HC_6H_{12}$—, $HC_8F_{16}$—, or

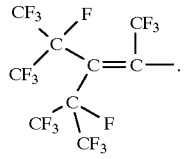

Specific examples of the fluorine-containing compound of formula (III) are as follows:

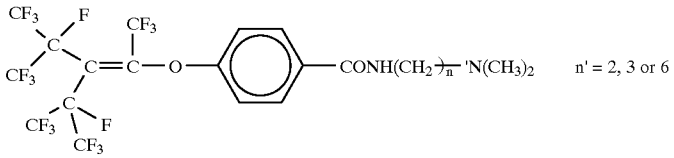

n' = 2, 3 or 6

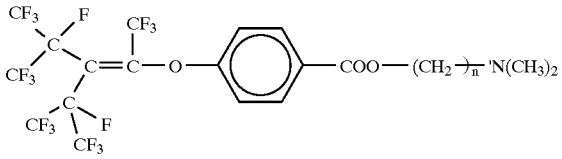

n' = 2, 3 or 6

-continued

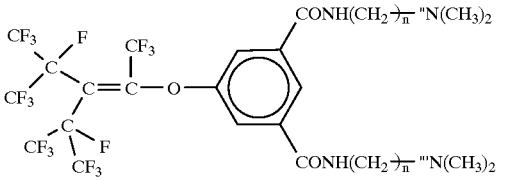

n" = 2, 3 or 6 n'" = 2, 3 or 6

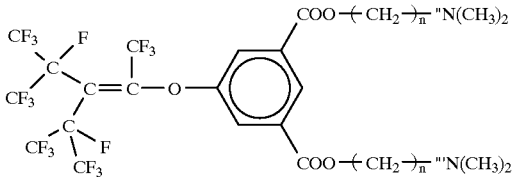

n" = 2, 3 or 6 n'" = 2, 3 or 6

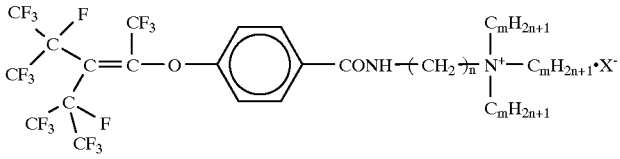

n = 2, 3 or 6, m = 1, 2, 3 or 4,

X = Cl, Br or I

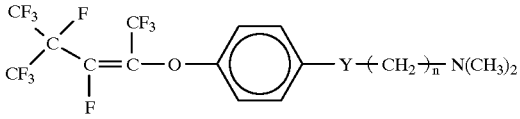

n = 2, 3 or 6,

Y = —CONH—, or —COO—

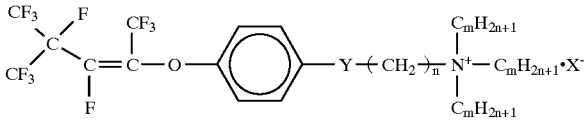

n = 2, 3 or 6, m = 1, 2, 3 or 4,

Y = —CONH—, or —COO—,

X = Cl, Br or I

Of the fluorine-containing compounds of formula (III), a fluorine-containing compound of the following formula in most preferably employed in the present invention in order to effectively control the charging characteristics of the toner:

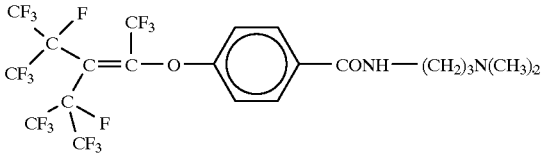

As the dispersion stabilizer used when the above compound is caused to be chemically bonded to the carboxylic acid and/or sulfonic acid in the surface of the toner, for example, the following dispersion stabilizers can be employed:

"GANT AN-119" (Trademark), made by BASF Japan Ltd.

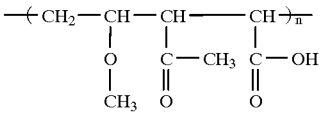

"SMA" (Trademark), made by Kawahara Petrochemical Co., LTd.

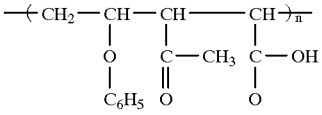

For providing the surface of the toner particles with the fluorine-containing compound of formula (III), the following two methods can be employed:

(1) The fluorine-containing compound of formula (III) is caused to be chemically bonded to a carboxylic acid of the dispersion stabilizer in the surface of the polymer particles.

(2) The fluorine-containing compound of formula (III) is caused to be chemically bonded to a sulfonic acid in the anionic monomer added when preparing the previously mentioned polymer particles.

For the above chemical bonding between the fluorine-containing compound of formula (III) and the carboxylic acid and/or the sulfonic acid, thorough washing of the dyed particles is required to remove (a) the dispersion stabilizer which is not deposited on the surface of the dyed particles and remains in the organic solvent in which the dyed particles are dispersed, (b) a small amount of the unreacted monomers, and (c) a residual dye remaining in the solvent (methanol). As long as the dyed toner particles are thoroughly washed, even if the fluorine-containing compound is exclusively added, the excessive fluorine-containing compound does not have any adverse effects on the charge quantity of the obtained color toner.

For instance, in the came where the previously mentioned commercially available dispersion stabilizer "GANT" (Trademark), made by BASP Japan Ltd. is employed for the polymerization system, and t-butylacrylamide sulfonic acid is added thereto as an anionic monomer in an amount of 3 wt. % to obtain a color toner with a particle diameter of about 5 μm, the charge quantity of the obtained color toner is not changed if the amount of the fluorine-containing compound of formula (III) exceed 0.3 parts by weight with respect to 100 parts by weight of the dyed toner particles. This is because the number of functional groups of carboxylic acid and/or sulfonic acid which is deposited on the surface of the toner particles is determined by the amount of the dispersion stabilizer or the anionic monomer added to the polymerization system. The carboxylic acid and/or sulfonic acid which exists on the surface of the toner particles is saturated with the predetermined amount of tertiary amine in the fluorine-containing compound.

As mentioned above, the amount of the fluorine-containing compound depends on the amount of the dispersion stabilizer and that of the anionic monomer which are used in the preparation of the polymer particles for the binder resin component. The desirable amount of the fluorine-containing compound is equimolar amount or more of the carboxylic acid and/or sulfonic acid present on the surface of the toner particles. In other words, it is preferable that the amount of the fluorine-containing compound be in the range from 0.01 to 1 parts by weight to 100 parts by weight of the dyed toner particles. When the amount of the fluorine-containing compound is within the above range, the environmental stability of the charging characteristics of the obtained toner is not decreased, and the resulting toner particles can be taken out of the solvent in a stable condition.

In the present invention, toner particles may be mixed with a fluidity-improving agent to fix the fluidity-improving agent on the surface of the toner particles, using a mixer such as a V-blender or a ball mill. In this case, conventionally known finely-divided particles with a particle diameter of 0.01 to 5 μm, for example, finely-divided particles of titanium oxide, silica which is surface-treated to hydrophobic, zinc stearate, and magnesium stearate can be employed as the fluidity-improving agents.

The toner according to the present invention can be used as a one-component developer, or a two-component developer in combination with a carrier. To prepare the two-component developer, carrier particles which are coated with aminosilane-containing silicone resin are desirable.

Other features of this invention will become apparent in the course of the following description of exemplary embodiments, which are given for illustration of the invention and are not intended to be limiting thereof.

SYNTHESIS EXAMPLE 1

[Synthesis of vinyl polymer particles No. 1]

100 parts by weight of methanol and 2.5 parts by weight of a commercially available styrene—maleic anhydride copolymer "AN-119" (Trademark) with a molecular weight of 40000, made by BASF Japan Ltd., were placed into a 500-ml hermetically-sealable four-necked separable flask in a constant-temperature water bath.

With the temperature of the constant-temperature Water bath being maintained at 65° C., the above mixture was stirred at 100 rpm to completely dissolve the styrene—maleic anhydride copolymer in methanol. Thus, a solution of a dispersion stabilizer was prepared.

250 parts by weight of the above prepared dispersion stabiliser solution were placed into a 500-ml hermetically-sealable four-necked separable flask in a constant-temperature water bath. The following components were added to the methanol solution:

| | Parts by Weight |
|---|---|
| Styrene | 63.5 |
| Methyl acrylate | 35 |
| Dodecyl mercaptan | 0.5 |
| 1,3-butanediol dimethacrylate | 1 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., and then the polymerization was initiated with the addition of 2.0 parts by weight of 2,2'-azobisisobutyronitrile serving as the polymerization initiator. The polymerization reaction was carried out for 24 hours.

Thereafter, the dispersion obtained by the polymerization was cooled to room temperature. After centrifugal sedimentation, the supernatant liquid was removed from the dispersion. The resulting resin particles were again dispersed with a mixed solvent consisting of 50 parts by weight of methanol and 50 parts by weight of water. This process was repeated three times. After the resin particles wore separated from the dispersion by filtration and air-dried, the resin particles were dried under reduced pressure at 40° C. for 6 hours. Thus, vinyl polymer particles No. 1 for use in a binder resin were obtained.

SYNTHESIS EXAMPLE 2

[Synthesis of vinyl polymer particles No. 2]

250 parts by weight of the some dispersion stabilizer solution as in Synthesis Example 1 were placed into a 500-ml hermatically-sealable four-necked separable flask in a constant-temperature water bath. The following components were added to the methanol solution:

| | Parts by Weight |
|---|---|
| Styrene | 63.5 |
| Methyl acrylate | 35 |
| Dodecyl mercaptan | 0.5 |
| 1,3-butanediol dimethacrylate | 1 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., and then the polymerization was initiated with the addition of 2.0 parts by weight of 2,2'-azobisisobutyronitrile serving as the polymerization initiator.

2.5 hours after the initiation of polymerization, 2 parts by weight of dodecyl mercaptan were diluted with 20 parts by weight of methanol and the thus obtained mixture was added to the polymerization system. Then, the polymerization reaction was terminated in 24 hours.

Thereafter, the dispersion obtained by the polymerization was cooled to room temperature. After centrifugal sedimentation, the supernatant liquid was removed from the dispersion. The resulting resin particles were again dispersed with a mixed solvent consisting of 50 parts by weight of methanol and 50 parts by weight of water. This process was repeated three times. After the resin particles were separated from the dispersion by filtration and air-dried, the resin particles were dried under reduced pressure at 40° C. for 6 hours. Thus, vinyl polymer particles No. 2 for use in a binder resin were obtained.

SYNTHESIS EXAMPLE 3

[Synthesis of vinyl polymer particles No. 3]

250 parts by weight of the same dispersion stabilizer solution as in Synthesis Example 1 were placed into a 500-ml hermetically-sealable four-necked separable flask in a constant-temperature water bath. The following components were added to the methanol solution:

| | Parts by Weight |
|---|---|
| Styrene | 63.5 |
| Methyl acrylate | 35 |
| Dodecyl mercaptan | 0.5 |
| 1,3-butanediol dimethacrylate | 1 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., and then the polymerization was initiated with the addition of 2.0 parts by weight of azobisisobutyronitrile serving as the polymerization initiator.

15 hours after the initiation of polymerization, a mixture of 20 parts by weight of styrene and 2 parts by weight of 1,3-butanediol dimethacrylate was diluted with 50 parts by weight of methanol and the thus obtained mixture was added to the polymerization system. With the addition of 2.0 parts by weight of 2,2'-azobisisobutyronitrile to the reaction mixture, the polymerization reaction was continued for 24 hours.

Thereafter, the dispersion obtained by the polymerization was cooled to room temperature. After centrifugal sedimentation, the supernatant liquid was removed from the dispersion. The resulting resin particles were again dispersed with a mixed solvent consisting of 50 parts by weight of methanol and 50 parts by weight of water. This process was repeated three times. After the resin particles were separated from the .dispersion by filtration and air-dried, the resin particles were dried under reduced pressure at 40° C. for 6 hours. Thus, vinyl polymer particles No. 3 for use in a binder resin were obtained.

Example 1

The following components were mixed and kneaded at 120° C. for 30 minutes in a two-roll mill:

| | Parts by Weight |
|---|---|
| Vinyl polymer particles No. 1 | 15 |
| Vinyl polymer particles No. 2 | 80 |
| Vinyl polymer particles No. 3 | 5 |
| Azo pigment (yellow) | 5 |
| Charge controlling agent "Bontron E-84" (Trademark), made by Orient Chemical Industries, Ltd. | 3 |

The above prepared mixture was roughly ground in a hammer mill and finely pulverized in an air jet mill, and then subjected to classification, so that toner particles No. 1 with a particle diameter of 4 to 9 $\mu$m according to the present invention were obtained.

50 g of the above prepared toner particles No. 1 and 950 g of commercially available iron powders "EFV200/300" (Trademark), made by Nippon Teppun Co., Ltd. were mixed and thoroughly stirred with the addition thereto of 10 g of finely-divided particles of silica. Thus, a two-component developer was prepared.

The weight-average molecular weight (Mw), and the peak molecular weight (PMw) in the weight-average molecular weight of the vinyl polymer particles for the binder resin, and the amount ratio of a vinyl polymer with a molecular weight of not less than the value of PMw×10 to the entire amount of the vinyl polymer are shown in Table 1.

The thus prepared developer was supplied to a commercially available copying apparatus "ARTAG8000 REALA" (Trademark), made by Ricoh Company, Ltd., to form toner images with the temperature of a heat-application roller in the image-fixing unit being met within the range of 100 to 190° C. The gloss of the obtained toner images was visually inspected. The results are shown in Table 1.

Figure 2A:
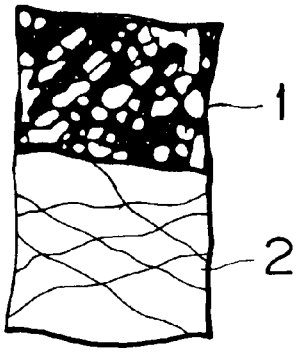
FIGS. 2(*a*) and 2(*b*) are schematic illustrations in explanation of the curling problem of a toner image fixed on an image-receiving medium, with a solid toner image being formed on a half of the image receiving medium.
Figure 2B:
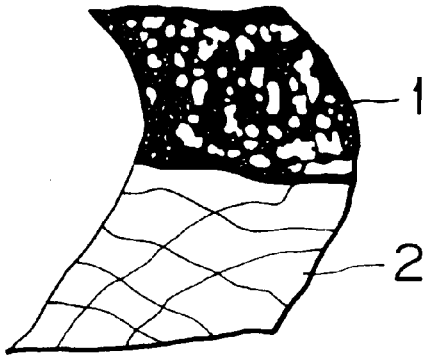
Figure 3:
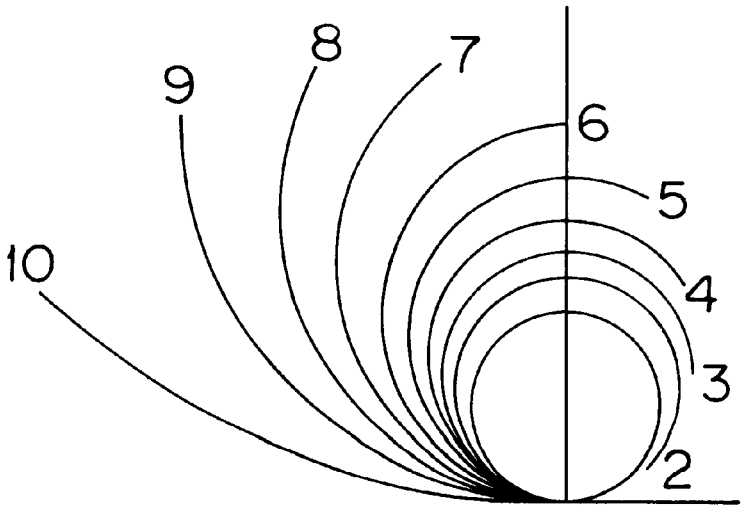
FIG. 3 is a diagram which shows the reference samples for the evaluation of the curling degree of the toner image fixed on the image-receiving medium.

In addition, a solid toner image was formed on a half of a sheet of high quality paper measuring 10 cm×9 cm in a deposition amount of about 1.5 mg/cm$^2$, as illustrated in FIG. 2(*a*). The solid-image-bearing paper slightly curled after the image-fixing process as shown in FIG. 2(*b*). The curling degree of the solid-image-bearing paper was obtained in comparison with the reference samples indicating the curling ranks shown in FIG. 3. The results are shown in Table 1. In FIGS. 2(*a*) and 2(*b*), reference numeral 2 indicates a portion on which no toner is deposited.

Example 2

The following components were mixed and kneaded at 120° C. for 30 minutes in a two-roll mill:

| | Parts by Weight |
|---|---|
| Vinyl polymer particles No. 1 | 7 |
| Vinyl polymer particles No. 2 | 90 |
| Vinyl polymer particles No. 3 | 3 |
| Quinacridone pigment (magenta) | 4 |
| Charge controlling agent "Bontron E-84" (Trademark), made by Orient Chemical Industries, Ltd. | 3 |

The above prepared mixture was roughly ground in a hammer mill and finely pulverized in an air jet mill, and then subjected to classification, so that toner particles No. 2 with a particle diameter of 4 to 9 $\mu$m according to the present invention were obtained.

Using the above prepared toner particles No. 2, a two-component developer was prepared in the same manner as in Example 1.

The weight-average molecular weight (Mw), and the peak molecular weight (PMw) in the weight-average molecular weight of the vinyl polymer particles for the binder resin, and the amount ratio of a vinyl polymer with a molecular weight of not less than the value of PMw×10 to the entire amount of the vinyl polymer are shown in Table 1.

Image formation was carried out by supplying the thus prepared developer to a commercially available copying apparatus "ARTAG8000 REALA" (Trademark), made by Ricoh Company, Ltd., and the gloss of the obtained toner images was visually inspected, and the curling degree of the solid-image-bearing paper was measured by the same method as in Example 1. The results are shown in Table 1.

Example 3

The following components were mixed and kneaded at 140° C. for 40 minutes in a two-roll mill:

| | Parts by Weight |
|---|---|
| Vinyl polymer particles No. 1 | 4 |
| Vinyl polymer particles No. 2 | 95 |
| Vinyl polymer particles No. 3 | 1 |
| Phthalocyanine pigment (cyan) | 4 |
| Charge controlling agent "Bontron E-84" (Trademark), made by Orient Chemical Industries, Ltd. | 3 |

The above prepared mixture was roughly ground in a hammier mill and finely pulverized in an air jet mill, and then subjected to classification, so that toner particles No. 3 with a particle diameter of 4 to 9 μm according to the present invention were obtained.

Using the above prepared toner particles No. 3, a two-component developer was prepared in the same manner as in Example 1.

The weight-average molecular weight (Mw), and the peak molecular weight (PMw) in the weight-average molecular weight of the vinyl polymer particles for the binder resin, and the amount ratio of a vinyl polymer with a molecular weight of not less than the value of PMw×10 to the entire amount of the vinyl polymer are shown in Table 1.

Image formation was carried out by supplying the thus prepared developer to a commercially available copying apparatus "ARTAG8000 REALA" (Trademark), made by Ricoh Company, Ltd., and the gloom of the obtained toner images was visually inspected, and the curling degree of the solid-image-bearing paper wow measured by the same method as in Example 1. The results are shown in Table 1.

Comparative Example 1

The following components were mixed and kneaded at 140° C. for 40 minutes in a two-roll mill:

| | Parts by Weight |
|---|---|
| Vinyl polymer particles No. 1 | 50 |
| Vinyl polymer particles No. 3 | 50 |
| Phthalocyanine pigment (cyan) | 4 |
| Charge controlling agent "Bontron E-84" (Trademark), made by Orient Chemical Industries, Ltd. | 3 |

The above prepared mixture was roughly ground in a hammer mill and finely pulverized in an air jet mill, and then subjected to classification, so that comparative toner particles No. 1 with a particle diameter of 4 to 9 μm were obtained.

Using the above prepared comparative toner particles No. 1, a two-component developer was prepared in the same manner as in Example 1.

The weight-average molecular weight (Mw), and the peak molecular weight (PMw) in the weight-average molecular weight of the vinyl polymer particles for the binder resin, and the amount ratio of a vinyl polymer with a molecular weight of not less than the value of PMw×10 to the entire amount of the vinyl polymer are shown in Table 1.

Image formation was carried out by supplying the thus prepared developer to a commercially available copying apparatus "ARTAG8000 REALA" (Trademark), made by Ricoh Company, Ltd., and the gloss of the obtained toner images was visually inspected, and the curling degree of the solid-image-bearing paper was measured by the same method as in Example 1. The results are shown in Table 1.

Comparative Example 2

The following components were mixed and kneaded at 140° C. for 40 minutes in a two-roll mill:

| | Parts by Weight |
|---|---|
| Vinyl polymer particles No. 1 | 30 |
| Vinyl polymer particles No. 2 | 70 |
| Phthalocyanine pigment (cyan) | 4 |
| Charge controlling agent "Bontron E-84" (Trademark), made by Orient Chemical Industries, Ltd. | 3 |

The above prepared mixture was roughly ground in a hammer mill and finely pulverized in an air jet mill, and then subjected to classification, so that comparative toner particles No. 2 with a particle diameter of 4 to 9 μm were obtained.

Using the above prepared comparative toner particles No. 2, a two-component developer was prepared in the same manner as in Example 1.

The weight-average molecular weight (Mw), and the peak molecular weight (PMw) in the weight-average molecular weight of the vinyl polymer particles for the binder resin, and the amount ratio of a vinyl polymer with a molecular weight of not less than the value of PMw×10 to the entire amount of the vinyl polymer are shown in Table 1.

Image formation was carried out by supplying the thus prepared developer to a commercially available copying apparatus "ARTAG8000 REALA" (Trademark), made by Ricoh Company, Ltd., and the gloss of the obtained toner images was visually Inspected, and the curling degree of the solid-image-bearing paper was measured by the same method as in Example 1. The results are shown in Table 1.

Comparative Example 3

The following components were mixed and kneaded at 140° C. for 40 minutes in a two-roll mill:

| | Parts by Weight |
|---|---|
| Vinyl polymer particles No. 1 | 10 |
| Vinyl polymer particles No. 2 | 90 |
| Phthalocyanine pigment (cyan) | 4 |
| Charge controlling agent "Bontron E-84" (Trademark), made by Orient Chemical Industries, Ltd. | 3 |

The above prepared mixture was roughly ground in a hammer mill and finely pulverized in an air jet mill, and then subjected to classification, so that comparative toner particles No. 3 with a particle diameter of 4 to 9 μm were obtained.

Using the above prepared comparative toner particles No. 3, a two-component developer was prepared in the same manner as in Example 1.

The weight-average molecular weight (Mw), and the peak molecular weight (PMw) in the weight-average molecular weight of the vinyl polymer particles for the binder resin, and the mount ratio of a vinyl polymer with a molecular weight of not less than the value of PMw×10 to the entire amount of the vinyl polymer are shown in Table 1.

Image formation was carried out by supplying the thus prepared developer to a commercially available copying apparatus "ARTAG8000 REALA" (Trademark), made by Ricoh Company, Ltd., and the gloss of the obtained toner images was visually inspected, and the curling degree of the solid-image-bearing paper was measured by the same method as in Example 1. The results are shown in Table 1.

TABLE 1

| | Mw(*) of Vinyl Polymer | PMw(**) of Vinyl Polymer | Ratio of Polymer with PMw × 10 or more | Gloss of Toner Images | Degree of Curling |
|---|---|---|---|---|---|
| Ex. 1 | 28000 | 10000 | 26 wt. % | good | 10 or more |
| Ex. 2 | 18000 | 6000 | 10 wt. % | good | 10 or more |
| Ex. 3 | 15000 | 5200 | 1 wt. % | good | 10 or more |
| Comp. Ex. 1 | 80000 | 50000 | 33 wt. % | none | 7 |
| Comp. Ex. 2 | 28000 | 11000 | 0 wt. % | none | 5 |
| Comp. Ex. 3 | 15000 | 8000 | 0 wt. % | good | 4 |

(*)Mw: weight-average molecular weight
(**)PMw: peak molecular weight

As can be seen from the results in Table 1, the proper gloss cannot be obtained in the toner images in Comparative Example 1 because the weight-average molecular weight of the vinyl polymer particle for the binder resin exceeds 30000. Even when the weight-average molecular weight of the vinyl polymer particles is 30000 or less, the proper gloss cannot be obtained in the toner images in Comparative Example 2 because the peak molecular weight in the weight-average molecular weight of the vinyl polymer particles exceeds 10000. In addition, even though the weight-average molecular weight of the vinyl polymer for the binder resin is 30000 or less and the peak molecular weight in the weight-average molecular weight of the vinyl polymer in 10000 or less, the curling problem of the toner images occurs in Comparative Example 3 because there is no vinyl polymer with a weight-average molecular weight of ten times or more the peak molecular weight in the vinyl polymer particles.

On the other hand, the low-molecular weight components and the high-molecular weight components are appropriately contained in the binder resin in Examples 1 to 3, so that the obtained toner images are provided with proper gloss and the curling of the toner images can be minimized.

Example 4

250 parts by weight of the same dispersion stabilizer solution as in Synthesis Example 1 were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |

-continued

| | Parts by Weight |
|---|---|
| Dodecyl mercaptan | 0.2 |
| Crosslinking agent "No. 335", made by Osaka Organic Chemical Industry Ltd. | 1.6 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., thereby initiating the polymerization with the addition of 2.25 parts by weight of 2,2'-azobis(2,4-dimethylvalarenitrile serving as the polymerization initiator.

One hour after the initiation of polymerization, 2.5 parts by weight of dodecyl mercaptan were diluted with 20 parts by weight of methanol and the thus obtained mixture was added to the polymerization system. Then, the polymerization reaction was continued for 24 hours. Thus, a slurry (A) of the vinyl polymer particles was obtained.

The weight-average molecular weight (Mw), and the peak molecular weight (PMw) in the weight-average molecular weight of the vinyl polymer particles in the slurry (A), and the amount ratio of a vinyl polymer with a molecular weight of not less than the value of PMw×10 to the entire amount of the vinyl polymer are shown in Table 2.

1.5 parts by weight of a commercially available coloring agent "Diaresin Yellow HL" (Trademark), made by Mitsubishi Chemical Industries, Ltd. were added to 20 parts by weight of methanol, and dissolved therein at 50° C. The thus prepared solution was cooled to room temperature and filtered through a microfilter having pores of 1 $\mu$m. The filtrate thus obtained was added to 140 parts by weight of the slurry (A). After the mixture was stirred at 50° C. for 2 hours, the dispersion was cooled to room temperature. After centrifugal sedimentation, the supernatant liquid was removed from the dispersion. The resulting resin particles were again dispersed with a mixed solvent consisting of 50 parts by weight of methanol and 50 parts by weight of water. This process was repeated three times. The dyed resin particles were separated from the dispersion by filtration and air-dried, and then, dried under reduced pressure at 40° C. for 6 hours. Thus, yellow toner particles according to the present invention were obtained.

The procedure for preparation of the above-mentioned yellow toner particles was repeated except that 1.5 parts by weight of "Diaresin Yellow HL" (Trademark), made by Mitsubishi Chemical Industries, Ltd. were replaced by 1.2 parts by weight of "TON Magenta 101" (Trademark), made by Mitsui Toatsu Chemicals, Inc., so that magenta toner particles according to the present invention were obtained.

The procedure for preparation of the above-mentioned yellow toner particles was repeated except that 1.5 parts by weight of "Diaresin Yellow HL" (Trademark), made by Mitsubishi Chemical Industries, Ltd. were replaced by 1.2 parts by weight of "MS Cyan HS-144" (Trademark), made by Mitsui Toatsu Chemicals, Inc., so that cyan toner particles according to the present invention were obtained.

50 g of each color toner particles and 950 g of commercially available iron powders "EPV200/300" (Trademark), made by Nippon Teppun Co., Ltd. were mixed and thoroughly stirred with the addition thereto of 10 g of finely-divided particles of silica. Thus, a two-component developer was prepared.

Image formation was carried out by supplying the thus prepared three kinds of developers to a commercially available copying apparatus "ARTAG8000 REALA" (Trademark), made by Ricoh company, Ltd., and the gloss of the obtained toner images was visually inspected by superimposing the colors, and the curling degree of the solid-image-bearing paper was measured by the same method as in Example 1. The results are shown in Table 2.

Example 5

The procedure for preparation of the slurry (A) of vinyl polymer particles in Example 4 was repeated except that the mixture of 2.5 parts by weight of dodecyl mercaptan and 20 parts by weight of methanol as prepared in Example 4 was added to the polymerization system 2 hours after the initiation of polymerization, so that a slurry (B) of vinyl polymer particles was obtained.

The weight-average molecular weight (Mw), and the peak molecular weight (PMw) in the weight-average molecular weight of the vinyl polymer particles in the slurry (B), and the amount ratio of a vinyl polymer with a molecular weight of not less than the value of PMw×10 to the entire amount of the vinyl polymer are shown in Table 2.

Using the above obtained slurry (B), yellow, magenta and cyan toner particles according to the present invention were obtained, and a two-component developer was prepared in the same manner an in Example 4.

Image formation was carried out by supplying the thus prepared three kinds of developers to a commercially available copying apparatus "ARTAG8000 REALA" (Trademark), made by Ricoh Company, Ltd., and the gloss of the obtained toner images was visually inspected by superimposing the colors, and the curling degree of the solid-image-bearing paper was measured by the same method an in Example 1. The results are shown in Table 2.

Comparative Example 4

The procedure for preparation of the slurry (A) of vinyl polymer particles in Example 4 was repeated except that the mixture of 2.5 parts by weight of dodecyl mercaptan and 20 parts by weight of methanol as prepared in Example 4 was added to the polymerization system 3 hours after the initiation of polymerization, so that a slurry (C) of vinyl polymer particles was obtained.

The weight-average molecular weight (Mw), and the peak molecular weight (PMw) in the weight-average molecular weight of the vinyl polymer particles in the slurry (C), and the amount ratio of a vinyl polymer with a molecular weight of not less than the value of PMw×10 to the entire amount of the vinyl polymer are shown in Table 2.

Using the above obtained slurry (C), comparative yellow, magenta and cyan toner particles were obtained, and a two-component developer was prepared in the same manner as in Example 4.

Image formation was carried out by supplying the thug prepared three kinds of developers to a commercially available copying apparatus "ARTAG8000 REALA" (Trademark), made by Ricoh Company, Ltd., and the gloss of the obtained toner images was visually inspected by superimposing the colors, and the curling degree of the solid-image-bearing paper was measured by the same method as in Example 1. The results are shown in Table 2.

TABLE 2

| | Mw(*) of Vinyl Polymer | PMw(**) of Vinyl Polymer | Ratio of Polymer with PMw × 10 or more | Conversion of Polymerization (***) | Gloss of Toner Images | Degree of Curling |
|---|---|---|---|---|---|---|
| Ex. 4 | 14000 | 5100 | 12 wt. % | 16% | good | 10 or more |
| Ex. 5 | 28000 | 9000 | 24 wt. % | 29% | good | 10 or more |
| Comp. Ex. 4 | 32000 | 11000 | 35 wt. % | 31% | none | 7 |

(*) Mw: weight-average molecular weight
(**) PMw: peak molecular weight
(***) Conversion of polymerization was measured when the chain transfer agent was added to the polymerization system in the preparation of the slurry of resin particles.

As can be seen from the results in Table 2, it is confirmed that when the polyfunctional monomer is employed at the initiation of polymerization, it is important to add the chain transfer agent to the polymerization system until the conversion of polymerization reaches 30%. Thus, the proper gloss can be imparted to the toner images and the curling of toner images can be prevented after image-fixing.

Example 6

250 parts by weight of the same dispersion stabilizer solution as in Synthesis Example 1 were placed into a 500-ml hermetically-sealable four-necked separable flank in a constant-temperature water bath. The following components were added to the methanol solution:

| | Parts by Weight |
|---|---|
| Styrene | 60 |
| Methyl acrylate | 40 |
| Dodecyl mercaptan | 0.2 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., thereby initiating the polymerization with the addition of 1.5 parts by weight of 2,2'-azobisisobutyronitrile serving as the polymerization initiator.

One hour after the initiation of polymerization, 2.5 parts by weight of dodecyl mercaptan were diluted with 20 parts by weight of methanol and the thus obtained mixture was added to the polymerization system.

10 hours after the initiation of polymerization, a mixture of 2.5 parts by weight of 1,3-butanediol dimethacrylate and 20 parts by weight of styrene was diluted with 50 parts by weight of methanol, and the thus obtained mixture was added to the polymerization system. Immediately after that, 1.5 parts by weight of 2,2'-azobisisobutyronitrile were further added to the polymerization system, and then, the polymerization reaction was continued for 24 hours. Thus, a slurry (D) of vinyl polymer particles was obtained.

The weight-average molecular weight (Mw), and the peak molecular weight (PMw) in the weight-average molecular weight of the vinyl polymer particles in the slurry (D), and the amount ratio of a vinyl polymer with a molecular weight of not less than the value of PMw×10 to the entire amount of the vinyl polymer are shown in Table 3.

Using the above obtained slurry (D), yellow, magenta and cyan toner particles according to the present invention were prepared, and a two-component developer was obtained in the same manner as in Example 4.

Image formation was carried out by supplying the thus prepared three kinds of developers to a commercially available copying apparatus "ARTAG8000 REALA" (Trademark), made by Ricoh Company, Ltd., and the gloss of the obtained toner images was visually inspected by superimposing the colors, and the curling degree of the solid-image-bearing paper was measured by the same method an in Example 1. The results are shown in Table 3.

Comparative Example 5

The procedure for preparation of the slurry (D) of vinyl polymer particles in Example 6 was repeated except that a mixture of 2.0 parts by weight of 1,3-butanediol dimethacrylate and 20 parts by weight of styrene was diluted with 50 parts by weight of methanol and the thus obtained mixture was added to the polymerization system 8 hours after the initiation of polymerization, so that a slurry (E) of vinyl polymer particles was obtained.

The weight-average molecular weight (Mw), and the peak molecular weight (PMw) in the weight-average molecular weight of the vinyl polymer particles in the slurry (E), and the amount ratio of a vinyl polymer with a molecular weight of not less than the value of PMw×10 to the entire amount of the vinyl polymer are shown in Table 3.

Using the above obtained slurry (E), comparative yellow, magenta and cyan toner particles were obtained, and a two-component developer was prepared in the same manner as in Example 4.

Image formation was carried out by supplying the thus prepared three kinds of developers to a commercially available copying apparatus "ARTAG8000 REALA" (Trademark), made by Ricoh Company, Ltd., and the gloss of the obtained toner images was visually inspected by superimposing the colors, and the curling degree of the solid-image-bearing paper was measured by the same method as in Example 1. The results are shown in Table 3.

TABLE 3

| | Mw(*) of Vinyl Polymer | PMw(**) of Vinyl Polymer | Ratio of Polymer with PMw × 10 or more | Conversion of Polymerization (***) | Gloss of Toner Images | Degree of Curling |
|---|---|---|---|---|---|---|
| Ex. 6 | 20000 | 9000 | 18 wt. % | 65% | good | 10 or more |
| Comp. Ex. 5 | 35000 | 12000 | 34 wt. % | 54% | none | 5 |

(*) Mw: weight-average molecular weight
(**) PMw: peak molecular weight
(***) Conversion of polymerization was measured when the crosslinking agent and styrene were added to the polymerization system in the preparation of the slurry of vinyl polymer particles.

As can be seen from the results in Table 3, not only the proper gloss can be imparted to the toner images, but also the toner images fixed on the image-receiving medium causes no curling problem in the came where the cross-linking agent is further added to the polymerization system after the conversion of polymerization reaches 60% in the preparation of the rosin particles for the binder resin.

Example 7

250 parts by weight of the same dispersion stabilizer solution as in Synthesis Example 1 were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.2 |
| Crosslinking agent "No. 335", made by Osaka Organic Chemical Industry Ltd. | 1.6 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., thereby initiating the polymerization with the addition of 2.25 parts by weight of 2,2'-azobis(2,4-dimethylvaleronitrile) serving as the polymerization initiator.

One hour after the initiation of polymerization, 2.5 parts by weight of dodecyl mercaptan were diluted with 20 parts by weight of methanol and the thus obtained mixture was added to the polymerization system.

15 hours after the initiation of polymerization, water was let out of the water bath to decrease the temperature of the polymerization system to room temperature. Three parts by weight of tert-butyl acrylamidesulfonic acid were previously dissolved in 50 parts by weight of methanol, and diluted with a mixture of 27 parts by weight of styrene and 10 parts by weight of methanol. The thus obtained solution containing the ionic monomer was added dropwise to the polymerization system over a period of about one hour.

After the completion of dropping, it was confirmed that the concentration of oxygen in the polymerization system was decreased to 0.1 vol. % or less, and the polymerization was further continued for 24 hours with the addition of 1.5 parts by weight of 2,2'-azobisisobutyronitrile. Thus, a slurry (F) of vinyl polymer particles was obtained.

The weight-average molecular weight (Mw) of the vinyl polymer in the slurry (F) was 17000, the peak molecular weight (PMw) in the weight-average molecular weight of the vinyl polymer was 5000, and the amount ratio of a vinyl polymer with a molecular weight of not less than the value of PMw×10 was 8 wt. % of the entire amount of the vinyl polymer.

Using the above obtained slurry (F), yellow, magenta and cyan toner particles according to the present invention were prepared, and a two-component developer was obtained in the same manner an in Example 6.

Image formation was carried out by supplying the thus prepared three kinds of developers to a commercially available copying apparatus "ARTAG8000 REALA" (Trademark), made by Ricoh Company, Ltd., and the gloss of the obtained toner images was visually inspected by superimposing the colors, and the curling degree of the solid-image-bearing paper was measured by the same method as in Example 1. As a result, the obtained toner images were provided with the proper gloss and the degree of the curling of the toner image was 10 or more.

In addition, the toner smoothly acquired a sufficient charging quantity. More specifically, the charge quantity of the toner reached −20 $\mu$C/g when the developer was stirred by a magnetic roller for one minute.

Example 8

250 parts by weight of the same dispersion stabilizer solution an in Synthesis Example 1 were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.2 |
| 1,3-butanediol dimethacrylate | 1.5 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., thereby initiating the polymerization with the addition of 1.5 parts by weight of 2,2'-azobisisobutyronitrile serving as the polymerization initiator.

One hour after the initiation of polymerization, 2.5 parts by weight of dodecyl mercaptan were diluted with 20 parts by weight of methanol and the thus obtained mixture was added to the polymerization system.

24 hours after the initiation of polymerization, 20 parts by weight of styrene were diluted with 50 parts by weight of methanol, and the thus prepared mixture was added to the polymerization system. Thereafter, with the addition of 2.07 parts by weight of 2,2'-azobisisobutyronitrile, the polymerization reaction was further continued for 24 hours. Thus, a slurry (G) of vinyl polymer particles was obtained.

The weight-average molecular weight (Mw), and the peak molecular weight (PMw) in the weight-average molecular weight of the vinyl polymer particles in the slurry (G), and the amount ratio of a vinyl polymer with a molecular weight of not less than the value of PMw×10 to the entire amount of the vinyl polymer are shown in Table 4.

Using the above obtained slurry (G), yellow, magenta and cyan toner particles according to the present invention were prepared, and a two-component developer was obtained in the same manner as in Example 6.

Image formation was carried out by supplying the thus prepared three kinds of developers to a commercially available copying apparatus "ARTAG8000 REALA" (Trademark), made by Ricoh Company, Ltd., and the gloss of the obtained toner images was visually inspected by superimposing the colors, and the curling degree of the solid-image-bearing paper was measured by the same method as in Example 1. The results are shown in Table 4.

Example 9

250 parts by weight of the same dispersion stabilizer solution as in Synthesis Example 1 were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.2 |
| Crosslinking agent "No. 335", made by Osaka Organic Chemical Industry Ltd. | 2 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., thereby initiating the polymerization with the addition of 2.25 parts by weight of 2,2'-azobis(2,4-dimethylvaleronitrile) serving as the polymerization initiator.

One hour after the initiation of polymerization, 3 parts by weight of dodecyl mercaptan were diluted with 20 parts by weight of methanol and the thus obtained mixture was added to the polymerization system.

24 hours after the initiation of polymerization, 20 parts by weight of styrene wore diluted with 50 parts by weight of methanol, and the thus prepared mixture was added to the polymerization system. Thereafter, with the addition of 1.38 parts by weight of 2,2'-azobisisobutyronitrile, the polymerization reaction was further continued for 24 hours. Thus, a slurry (H) of vinyl polymer particles was obtained.

The weight-average molecular weight (Mw), and the peak molecular weight (PMw) in the weight-average molecular weight of the vinyl polymer particles in the slurry (H), and the amount ratio of a vinyl polymer with a molecular weight of not less than the value of PMw×10 to the entire amount of the vinyl polymer are shown in Table 4.

Using the above obtained slurry (H), yellow, magenta and cyan toner particles according to the present invention were prepared, and a two-component developer was obtained in the same manner as in Example 6.

Image formation was carried out by supplying the thus prepared three kinds of developers to a commercially available copying apparatus "ARTAG8000 REALA" (Trademark), made by Ricoh Company, Ltd., and the gloss of the obtained toner images warn visually inspected by superimposing the colors, and the curling degree of the solid-image-bearing paper was measured by the same method as in Example 1. The results are shown in Table 4.

Comparative Example 6

250 parts by weight of the same dispersion stabilizer solution an in Synthesis Example 1 were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.2 |
| 1,3-butanediol dimethacrylate | 1.5 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., thereby initiating the polymerization with the addition of 1.5 parts by weight of 2,2'-azobisisobutyronitrile serving as the polymerization initiator.

One hour after the initiation of polymerization, 3 parts by weight of dodecyl mercaptan ware diluted with 20 parts by weight of methanol and the thus obtained mixture was added to the polymerization system.

24 hours after the initiation of polymerization, 20 parts by weight of styrene were diluted with 50 parts by weight of methanol, and the thus prepared mixture was added to the polymerization system. Thereafter, with the addition of 0.69 parts by weight of 2,2'-azobisisobutyronitrile, the polymerization reaction was further continued for 24 hours. Thus, a slurry (I) of vinyl polymer particles was obtained.

The weight-average molecular weight (Mw), and the peak molecular weight (PMw) in the weight-average molecular weight of the vinyl polymer particles in the slurry (I), and the amount ratio of a vinyl polymer with a molecular weight of not less than the value of PMw×10 to the entire amount of the vinyl polymer are shown in Table 4.

Using the above obtained slurry (I), comparative yellow, magenta and cyan toner particles were prepared, and a two-component developer was obtained in the same manner as in Example 6.

Image formation was carried out by supplying the thus prepared three kinds of developers to a commercially available copying apparatus "ARTAG8000 REALA" (Trademark), made by Ricoh Company, Ltd., and the gloss of the obtained toner images was visually inspected by superimposing the colors, and the curling degree of the solid-image-bearing paper was measured by the same method as in Example 1. The results are shown in Table 4.

Comparative Example 7

250 parts by weight of the same dispersion stabilizer solution as in Synthesis Example 1 were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.2 |
| 1,3-butanediol dimethacrylate | 1.5 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., thereby initiating the polymerization with the addition of 2.25 parts by weight of 2,2'-azobis(2,4-dimethylvaleronitrile) serving as the polymerization initiator.

One hour after the initiation of polymerization, 3 parts by weight of dodecyl mercaptan were diluted with 20 parts by weight of methanol and the thus obtained mixture was added to the polymerization system.

24 hours after the initiation of polymerization, 20 parts by weight of styrene were diluted with 50 parts by weight of methanol, and the thus prepared mixture was added to the polymerization system. Thereafter, with the addition of 0.55 parts by weight of 2,2'-azobisisobutyronitrile, the polymerization reaction was further continued for 24 hours. Thus, a slurry (J) of vinyl polymer particles was obtained.

The weight-average molecular weight (Mw), and the peak molecular weight (PMw) in the weight-average molecular weight of the vinyl polymer particles in the slurry (J), and the amount ratio of a vinyl polymer with a molecular weight of not less than the value of PMw×10 to the entire amount of the vinyl polymer are shown in Table 4.

Using the above obtained slurry (J), comparative yellow, magenta and cyan toner particles were prepared, and a two-component developer was obtained in the same manner as in Example 6.

Image formation was carried out by supplying the thus prepared three kinds of developers to a commercially available copying apparatus "ARTAG8000 REALA" (Trademark), made by Ricoh Company, Ltd., and the gloss of the obtained toner images was visually inspected by superimposing the colors, and the curling degree of the solid-image-bearing paper was measured by the same method an in Example 1. The results are shown in Table 4.

Comparative Example 8

250 parts by weight of the same dispersion stabilizer solution as in Synthesis Example 1 were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.2 |
| 1,3-butanediol dimethacrylate | 1.5 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., thereby initiating the polymerization with the addition of 2.25 parts by weight of 2,2'-azobis(2,4-dimethylvaleronitrile) serving as the polymerization initiator.

One hour after the initiation of polymerization, 3 parts by weight of dodecyl mercaptan were diluted with 20 parts by weight of methanol and the thus obtained mixture was added to the polymerization system.

24 hours after the initiation of polymerization, 20 parts by weight of styrene were diluted with 30 parts by weight of methanol, and the thus prepared mixture was added to the polymerization system. Thereafter, with the addition of 0.34 parts by weight of 2,2'-azobisisobutyronitrile, the polymerization reaction was further continued for 24 hours. Thus, a slurry (K) of vinyl polymer particles was obtained.

The weight-average molecular weight (Mw), and the peak molecular weight (PMw) in the weight-average molecular weight of the vinyl polymer particles in the slurry (K), and the amount ratio of a vinyl polymer with a molecular weight of not less than the value of PMw×10 to the entire amount of the vinyl polymer are shown in Table 4.

Using the above obtained slurry (K), comparative yellow, magenta and cyan toner particles were prepared, and a two-component developer was obtained in the same manner an in Example 6.

Image formation was carried out by supplying the thus prepared three kinds of developers to a commercially available copying apparatus "ARTAG8000 REALA" (Trademark), made by Ricoh Company, Ltd., and the gloss of the obtained toner image was visually inspected by superimposing the colors, and the curling degree of the solid-image-bearing paper was measured by the same method as in Example 1. The results are shown In Table 4.

TABLE 4

| | Mw(*) of Vinyl Polymer | PMw(**) of Vinyl Polymer | Ratio of Polymer with PMw × 10 or more | Molar Ratio of Initiator to Monomer (***) | Gloss of Toner Images | Degree of Curling |
|---|---|---|---|---|---|---|
| Ex. 8 | 16000 | 4900 | 5 wt. % | 3.0/100 | good | 10 or more |
| Ex. 9 | 17000 | 5000 | 8 wt. % | 2.0/100 | good | 10 or more |
| Comp. Ex. 6 | 29000 | 10000 | 31 wt. % | 1.0/100 | none (****) | 6 |
| Comp. Ex. 7 | 36000 | 11000 | 33 wt. % | 0.8/100 | none | 6 |
| Comp. Ex. 8 | 59000 | 21000 | 40 wt. % | 0.5/100 | none | 6 |

(*) Mw: weight-average molecular weight
(**) PMw: peak molecular weight
(***) The molar ratio of the polymerization initiator to the monomers soluble in the polymerization system.
(***) When the temperature of the heat-application roller was maintained at 190° C. or more for the image-fixing process, the proper gloss was imparted to the toner images.

As can be seen from the results in Table 4, it is confirmed that when the molar ratio of the polymerization initiator to the monomers soluble in the polymerization system is 1:100 or more in the preparation of vinyl polymer particles, the gloss of the obtained toner image in excellent and the curling problem can be prevented.

Example 10

The same yellow, cyan and magenta toner particles according to the present invention as prepared in Example 4 were independently mixed and stirred with commercially available ferrite carrier particles coated with aminosilane-containing silicone resin, made by Powder Tec Co., Ltd., so that a two-component developer was obtained.

The thus obtained developer was set in a development unit, and the charge quantity of the toner was measured after stirring of the developer particles for one minute by use of a magnetic roller. The results are shown in Table 5.

Example 11

The same yellow, cyan and magenta toner particles according to the present invention as prepared in Example 5 were independently mixed and stirred with commercially available ferrite carrier particles coated with aminosilane-containing silicone resin, made by Powder Tec Co., Ltd., so that a two-component developer was obtained.

The thus obtained developer was set in a development unit, and the charge quantity of the toner was measured after stirring of the developer particles for one minute by use of a magnetic roller. The results are shown in Table 5.

Example 12

The same yellow, cyan and magenta toner particles according to the present invention as prepared in Example 6 were independently mixed and stirred with commercially available ferrite carrier particles coated with aminosilane-containing silicone resin, made by Powder Tec Co., Ltd., so that a two-component developer was obtained.

The thus obtained developer was met in a development unit, and the charge quantity of the toner was measured after stirring of the developer particles for one minute by use of a magnetic roller. The results are shown in Table 5.

Example 13

The same yellow, cyan and magenta toner particles according to the present invention as prepared in Example 7 were independently mixed and stirred with commercially available ferrite carrier particles coated with aminosilane-containing silicone resin, made by Powder Tec Co., Ltd., so that a two-component developer was obtained.

The thus obtained developer was set in a development unit, and the charge quantity of the toner was measured after stirring of the developer particles for one minute by use of a magnetic roller, The results are shown in Table 5.

Example 14

The same yellow, cyan and magenta toner particles according to the present invention as prepared in Example 8 were independently mixed and stirred with commercially available ferrite carrier particles coated with aminosilane-containing silicone resin, made by Powder Tec Co., Ltd., so that a two-component developer was obtained.

The thus obtained developer was set in a development unit, and the charge quantity of the toner was measured after stirring of the developer particles for one minute by use of a magnetic roller. The results are shown in Table 5.

TABLE 5

| | Charge Quantity of Toner (Carrier: Iron Powders) | | Charge Quantity of Toner (Carrier: Ferrite Particles Coated with Aminosilane-Containing Silicone Resin) |
|---|---|---|---|
| Ex. 4 | −3 to −9 μC/g | Ex. 10 | −16 to −26 μC/g |
| Ex. 5 | −3 to −9 μC/g | Ex. 11 | −16 to −26 μC/g |
| Ex. 6 | −3 to −9 μC/g | Ex. 12 | −16 to −26 μC/g |
| Ex. 7 | −20 to −23 μC/g | Ex. 13 | −30 to −34 μC/g |
| Ex. 8 | −3 to −9 μC/g | Ex. 14 | −16 to −26 μC/g |

As can be seen from the results shown in Table 5, the toner particles of the present invention can be readily charged to a sufficient level when the carrier particles coated with an aminosilane-containing silicone resin are used in combination. In particular, the charging performance of the toner particles prepared in Examples 7 and 13 are excellent because the ionic monomer is used in the preparation of the vinyl polymer particles for the binder resin of the toner.

SYNTHESIS EXAMPLE 4

[Preparation of slurry (L) of vinyl polymer particles]

100 parts by weight of methanol and 2.5 parts by weight of a commercially available styrene—maleic anhydride copolymer "AN-119" (Trademark) with a molecular weight of 40000, made by BASF Japan Ltd., were placed into a 500-ml hermetically-sealable four-necked separable flask in a constant-temperature water bath.

With the temperature of the constant-temperature water bath being maintained at 65° C., the above mixture was stirred at 100 rpm to completely dissolve the styrene—maleic anhydride copolymer in methanol. Thus, a solution of a dispersion stabilizer was prepared.

250 parts by weight of the above prepared dispersion stabilizer solution were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.25 |
| Crosslinking agent "No. 335", made by Osaka Organic Chemical Industry Ltd. | 1.6 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., and then the polymerization was initiated with the addition of 2.25 parts by weight of 2,2'-azobis(2,4-dimethylvaleronitrile serving as the polymerization initiator.

One hour after the initiation of polymerization, 2.6 parts by weight of dodecyl mercaptan were diluted with 20 parts by weight of methanol, and the thus obtained mixture was added to the polymerization system.

15 hours after the initiation of polymerization, 20 parts by weight of styrene and 4 parts by weight of a fluorine-containing vinyl monomer of formula (I) were diluted with 50 parts by weight of methanol. The thus obtained mixture was added to the polymerization system. Then, with the addition of 2.0 parts by weight of 2,2'-azobisisobutyronitrile, the polymerization reaction was carried out for 24 hours.

(I)

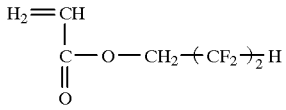

Thus, a slurry (L) of vinyl polymer particles for use in the binder resin of the toner was obtained.

SYNTHESIS EXAMPLE 5

[Preparation of slurry (M) of vinyl polymer particles]

The procedure for preparation of the slurry (L) of vinyl polymer particles in Synthesis Example 4 was repeated except that 4 parts by weight of the fluorine-containing vinyl monomer of formula (I) which was added to the polymerization system 15 hours after the initiation of polymerization in Synthesis Example 4 were replaced by 2.6 parts by weight of a fluorine-containing vinyl monomer of formula (II).

(II)

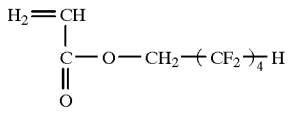

Thus, a slurry (M) of vinyl polymer particles for use in the binder resin of the toner was obtained.

SYNTHESIS EXAMPLE 6

[Preparation of slurry (N) of vinyl polymer particles]

The procedure for preparation of the slurry (L) of vinyl polymer particles in Synthesis Example 4 was repeated except that 2.5 parts by weight of the styrene—maleic anhydride copolymer used in the preparation of the dispersion stabilizer solution in Synthesis Example 4 were replaced by 3.0 parts by weight of styrene methacrylate copolymer.

Thus, a slurry (N) of vinyl polymer particles for use in the binder resin of the toner was obtained.

SYNTHESIS EXAMPLE 7

[Preparation of slurry (O) of vinyl polymer particles]

The procedure for preparation of the slurry (L) of vinyl polymer particles in Synthesis Example 4 was repeated except that the quantity of dodecyl mercaptan which was added to the polymerization system one hour after the initiation of polymerization in Synthesis Example 4 was changed from 2.6 parts by weight to 0.5 parts by weight.

Thus, a slurry (O) of vinyl polymer particles for use in the binder resin of the toner was obtained.

SYNTHESIS EXAMPLE 8

[Preparation of slurry (P) of vinyl polymer particles]

250 parts by weight of the same dispersion stabilizer solution as in Synthesis Example 4 were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.25 |
| Crosslinking agent "No. 335", made by Osaka Organic Chemical Industry Ltd. | 1.6 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., and then the polymerization was initiated with the addition of 2.25 parts by weight of 2,2'-azobis(2,4-dimethylvaleronitrile serving as the polymerization initiator.

One hour after the Initiation of polymerization, 2.6 parts by weight of dodecyl mercaptan were diluted with 20 parts by weight of methanol, and the thus obtained mixture was added to the polymerization system.

15 hours after the initiation of polymerization, 20 parts by weight of styrene, 2.6 parts by weight of the fluorine-containing vinyl monomer of formula (II), and 2.5 parts by weight of 1,3-butanediol dimethacrylate were diluted with 50 parts by weight of methanol. The thus obtained mixture was added to the polymerization system. Then, with the addition of 2.0 parts by weight of 2,2'-azobisisobutyronitrile, the polymerization reaction was carried out for 24 hours.

Thus, a slurry (P) of vinyl polymer particles for use in the binder resin of the toner was obtained.

SYNTHESIS EXAMPLE 9

[Preparation of slurry (Q) of vinyl polymer particles]

250 parts by weight of the same dispersion stabilizer solution as in Synthesis Example 4 were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.25 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., and then the polymerization was initiated with the addition of 2.25 parts by weight of 2,21-azobis(2,4-dimethylvaleronitrile serving an the polymerization initiator.

One hour after the initiation of polymerization, 2.6 parts by weight of dodecyl mercaptan were diluted with 20 parts by weight of methanol, and the thus obtained mixture was added to the polymerisation system.

15 hours after the initiation of polymerization, 20 parts by weight of styrene and 4 parts by weight of the fluorine-containing vinyl monomer of formula (I) were diluted with 50 parts by weight of methanol. The thus obtained mixture was added to the polymerization system. Then, with the addition of 2.0 parts by weight of 2,2'-azobisisobutyronitrile, the polymerization reaction was carried out for 24 hours.

Thus, a slurry (Q) of vinyl polymer particles for use in the binder resin of the toner was obtained.

SYNTHESIS EXAMPLE 10

[Preparation of slurry (R) of vinyl polymer particles]

250 parts by weight of the same dispersion stabilizer solution as in Synthesis Example 4 were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.25 |
| Crosslinking agent "No. 335", made by Osaka Organic Chemical Industry Ltd. | 1.6 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., thereby initiating the polymerization with the addition of 2.25 parts by weight of 2,2'-azobis(2,4-dimethylvaleronitrile) serving as the polymerization initiator.

One hour after the initiation of polymerization, 2.6 parts by weight of dodecyl mercaptan were diluted with 20 parts by weight of methanol and the thus obtained mixture was added to the polymerization system.

15 hours after the initiation of polymerization, water was let out of the water bath to decrease the temperature of the polymerization system to room temperature. Three parts by weight of tert-butyl acrylamidesulfonic acid were previously dissolved in 50 parts by weight of methanol, and diluted with a mixture of 27 parts by weight of styrene and 10 parts by weight of methanol. The thus obtained solution containing the ionic monomer was added dropwise to the polymerization system over a period of about one hour.

After the completion of dropping, it was confirmed that the concentration of oxygen in the polymerization system was decreased to 0.1 vol. % or less, and the polymerization was further continued for 24 hours with the addition of 1.5 parts by weight of 2,2'-azobisisobutyronitrile.

Thus, a slurry (R) of vinyl polymer particles for use in the binder resin of the toner was obtained.

SYNTHESIS EXAMPLE 11

[Preparation of slurry (S) of vinyl polymer particles]

100 parts by weight of methanol and 3.0 parts by weight of a styrene—methacrylate copolymer were placed into a 500-ml hermetically-sealable four-necked separable flask in a constant-temperature water bath.

With the temperature of the constant-temperature water bath being maintained at 65° C., the above mixture was stirred at 100 rpm to completely dissolve the styrene—methacrylate copolymer in methanol. Thus, a solution of a dispersion stabilizer was prepared.

250 parts by weight of the above prepared dispersion stabilizer solution were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.25 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., thereby initiating the polymerization with the addition of 2.25 parts by weight of 2,2'-azobis(2,4-dimethylvaleronitrile) serving as the polymerization initiator.

One hour after the initiation of polymerization, 0.5 parts by weight of dodecyl mercaptan were diluted with 20 parts by weight of methanol and the thus obtained mixture was added to the polymerization system.

15 hours after the initiation of polymerization, water was let out of the water bath to decrease the temperature of the polymerization system to room temperature. Three parts by weight of tert-butyl acrylamidesulfonic acid wore previously dissolved in 50 parts by weight of methanol, and diluted with a mixture of 27 parts by weight of styrene and 10 parts by weight of methanol. Thereafter, 3 parts by weight of 1,3-butanediol dimethacrylate were added to the above prepared mixture. The thus obtained mixture containing the ionic monomer was added dropwise to the polymerization system over a period of about one hour.

After the completion of dropping, it was confirmed that the concentration of oxygen in the polymerization system was decreased to 0.1 vol. % or less, and the polymerization was further continued for 24 hours with the addition of 1.5 parts by weight of 2,2'-azobisisobutyronitrile.

Thus, a slurry (S) of vinyl polymer particles for use in the binder resin of the toner was obtained.

SYNTHESIS EXAMPLE 12

[Preparation of slurry (T) of vinyl polymer particles]

100 parts by weight of methanol and 6.0 parts by weight of polyvinyl pyrrolidone were placed into a 500-ml hermetically-sealable four-necked separable flask in a constant-temperature water bath.

With the temperature of the constant-temperature water bath being maintained at 65° C., the above mixture was stirred at 100 rpm to completely dissolve the polyvinyl pyrrolidone in methanol. Thus, a solution of a dispersion stabilizer was prepared.

250 parts by weight of the above prepared dispersion stabilizer solution were placed into a 500-ml hermetically-sealable four-necked separable flask in a constant-temperature water bath. The following components were added to the methanol solution:

| | Parts by Weight |
|---|---|
| Styrene | 60 |
| Methyl acrylate | 40 |
| Dodecyl mercaptan | 0.25 |
| Croselinking agent "No. 335", made by Osaka Organic Chemical Industry Ltd. | 1.6 |

With stirring the mixture, nitrogen was introduced into the reaction system until the concentration of oxygen in the reaction system reached 0.1 vol. % or less. The reaction mixture was stirred at 100 rpm with the temperature of the water bath being maintained at 65° C., thereby initiating the polymerization with the addition of 2.25 parts by weight of 2,2'-azobis(2,4-dimethylvaleronitrile) serving as the polymerization initiator.

One hour after the initiation of polymerization, 2.6 parts by weight of dodecyl mercaptan were diluted with 20 parts by weight of methanol and the thus obtained mixture was added to the polymerization system.

15 hours after the initiation of polymerization, 20 parts by weight of styrene were diluted with 50 parts by weight of methanol, and the thus obtained mixture was added to the polymerization system.

The polymerization was further continued for 24 hours with the addition of 2.0 parts by weight of 2,2'-azobisisobutyronitrile.

Thus, a slurry (T) of vinyl polymer particles for use in the binder resin of the toner was obtained.

The weight-average molecular weight (Mw), and the peak molecular weight (PMw) in the average-molecular weight of the vinyl polymer particles of each slurry, and the amount ratio of a vinyl polymer with a molecular weight of not less than the value of PMw×10 to the entire amount of the vinyl polymer are shown in Table 6.

TABLE 6

| | Mw(*) of Vinyl Polymer | PMw(**) of Vinyl Polymer | Amount Ratio of Vinyl Polymer with PMw × 10 or more |
|---|---|---|---|
| Vinyl polymer in slurry (L) | 15000 | 8000 | 18 wt. % |
| Vinyl polymer in slurry (M) | 29000 | 9000 | 29 wt. % |
| Vinyl polymer in slurry (N) | 17000 | 9000 | 20 wt. % |
| Vinyl polymer in slurry (O) | 31000 | 10000 | 32 wt. % |
| Vinyl polymer in slurry (P) | 29000 | 13000 | 31 wt. % |
| Vinyl polymer in slurry (Q) | 11000 | 9000 | 0.9 wt. % |
| Vinyl polymer in slurry (R) | 18000 | 9000 | 24 wt. % |
| Vinyl polymer in slurry (S) | 18000 | 8000 | 23 wt. % |
| Vinyl polymer in slurry (T) | 25000 | 10000 | 25 wt. % |

(*)Mw: weight-average molecular weight
(**)PMw: peak molecular weight in the weight-average molecular weight Then, each slurry was subjected to dyeing in the following manner:

(1) Preparation of yellow dye solution 13 g of a commercially available dye "KP-Yellow HD-SF" (Trademark), made by Nippon Kayaku Co., Ltd. were dispersed with 247 g of a mixture of ion-exchange water and methanol with a mixing ratio by weight of 1:1 for 24 hours using a ball mill. Thus, a yellow dye solution with a concentration of 5 wt. % was prepared.

(2) Preparation of magenta dye solution

A mixture of 9 g of a commercially available dye "HSO-147" (Trademark), made by Mitsui Toatsu Dyes Ltd. and 3 g of a commercially available dye "REX 528" (Trademark), made by Mitsui Toatsu Dyes Ltd. was dispersed with 228 g of a mixture of ion-exchange water and methanol with a mixing ratio by weight of 1:1 for 24 hours using a ball mill. Thus, a magenta dye solution with a concentration of 5 wt. % was prepared.

(3) Preparation of cyan dye solution 12 g of a commercially available dye "KP Blue Green FG-S" (Trademark), made by Nippon Kayaku Co., Ltd. were dispersed with 228 g of a mixture of ion-exchange water and methanol with a mixing ratio by weight of 1:1 for 24 hours using a ball mill. Thus, a cyan dye solution with a concentration of 5 wt. % was prepared.

(4) Preparation of black dye solution

A mixture of 4.762 g of a commercially available dye "HM1378" (Trademark), made by Mitsui Toatsu Dyes Ltd., 4.762 g of a commercially available dye "EX30" (Trademark), made by Mitsui Toatsu Dyes Ltd,. 1.904 g of a commercially available dye "HS016" (Trademark), made by Mitsui Toatsu Dyes Ltd., and 0.571 g of a commercially available dye "RBX 528" (Trademark), made by Mitsui Toatsu Dyes Ltd. was dispersed with 228 g of a mixture of ion-exchange water and methanol with a mixing ratio by weight of 1:1 for 24 hours using a ball mill. Thus, a black dye solution with a concentration of 5 wt. % was prepared.

In the dyeing process, the black dye solution was added to the slurry of the vinyl polymer particles in such a manner that the amount ratio by weight of the vinyl polymer particles in the slurry to the solid content of the black dye solution was 100:4.8.

Example 15

Using the slurry (L) of the vinyl polymer particles, yellow, magenta, cyan and black toners according to the present invention were prepared in such a manner as mentioned in Example 4.

50 g of toner particles of each color and 950 g of commercially available iron powders "EFV200/300" (Trademark), made by Nippon Teppun Co., Ltd. were mixed and thoroughly stirred with the addition thereto of 10 g of finely-divided particles of silica. Thus, a two-component developer was obtained.

The thus obtained color developers were set in a commercially available copying apparatus "ARTAG8000 REALA" (Trademark), made by Ricoh Company, Ltd., to form the toner image, with the environmental conditions being changed to 10° C. and 15% RH, 23° C. and 60% RH, and 30° C. and 90% RH. The temperature of a heat-application roller in the image-fixing unit was met within the range of 100 to 180° C. for the image-fixing.

The gloss of the obtained toner image was visually inspected and the curling degree of the toner image fixed on an image-receiving medium was measured by the same method as in Example 1.

In addition, the image quality of the toner images obtained under the circumstances of high temperature and humidity, normal temperature and humidity, and low temperature and humidity were visually evaluated.

The results are shown in Table 7.

Examples 16 and 17 and Comparative Examples 9 to 11

The procedure for preparation of the yellow, magenta, cyan and black toners, and the two-component developers thereof as in Example 15 was repeated except that the slurry (L) of the vinyl polymer particles employed in Example 15 was respectively replaced by the slurries (M), (N), (O), (P), and (Q).

The thus obtained color developers were set in a commercially available copying apparatus "ARTAG8000 REALA" (Trademark), made by Ricoh Company, Ltd., to form the toner image, with the environmental conditions being changed to 10° C. and 15% RH, 23° C. and 60% RH, and 30° C. and 90% RH. The temperature of a heat-application roller in the image-fixing unit was set within the range of 100 to 180° C. for the image-fixing.

The gloss of the obtained toner image was visually inspected and the curling degree of the toner image fixed on an image-receiving medium was measured by the same method as in Example 1.

In addition, the image quality of the toner images obtained under the circumstances of high temperature and humidity, normal temperature and humidity, and low temperature and humidity were visually evaluated.

The results are shown in Table 7.

TABLE 7

| | Slurry | Gloss of Toner Image | Degree of Curl-ing | Image Quality (*) | Image Quality (**) | Image Quality (***) |
|---|---|---|---|---|---|---|
| Ex. 15 | (L) | good | 10 or more | good | good | good |
| Ex. 16 | (M) | good | 10 or more | good | good | good |
| Ex. 17 | (N) | good | 10 or more | good | good | good |
| Comp. Ex. 9 | (O) | none | 8 | good | good | good |

TABLE 7-continued

| | Slurry | Gloss of Toner Image | Degree of Curl-ing | Image Quality (*) | Image Quality (**) | Image Quality (***) |
|---|---|---|---|---|---|---|
| Comp. Ex. 10 | (P) | none | 7 | good | good | good |
| Comp. Ex. 11 | (Q) | good | 4 | good | good | good |

(*) Image formation was carried out under the circumstances of 10° C. and 15% RH.
(**) Image formation was carried out under the circumstances of 23° C. and 60% RH.
(***) Image formation was carried out under the circumstances of 30° C. and 90% RH.

As can be seen from the results in Table 7, the proper gloss cannot be obtained in the toner image in Comparative Example 9 because the weight-average molecular weight of the vinyl polymer particles for use in the binder resin exceeds 30000. Even when the weight-average molecular weight of the vinyl polymer particles in 30000 or less, the proper gloss cannot be obtained in the toner images in Comparative Example 10 because the peak molecular weight in the weight-average molecular weight of the vinyl polymer particles exceeds 10000. In addition, even though the weight-average molecular weight of the vinyl polymer for use in the binder resin is 30000 or less and the peak molecular weight in the weight-average molecular weight of the vinyl polymer is 10000 or less, the curling problem of the toner images occurs in Comparative Example 11 because there is no vinyl polymer with a weight-average molecular weight of ten times or more the peak molecular weight in the vinyl polymer particles.

On the other hand, the low-molecular weight components and the high-molecular weight components are appropriately contained in the binder resins in Examples 15 to 17, so that the obtained toner images are provided with proper gloss and the curling of the toner images can be minimized. Furthermore, a fluorine-containing vinyl monomer is used as a part of the vinyl monomers in the preparation of vinyl polymer particles for the binder resins in Examples 15 to 17, so that the produced color images are always sharp regardless of the temperature and humidity.

Example 18

The slurry (R) of the vinyl polymer particles was added to each of the yellow, magenta, cyan and black dye solutions to dye the vinyl polymer particles with the dye.

After the completion of dyeing the resin particles with the dye, the mixture was subjected to centrifugal sedimentation at 1000 rpm for 7 minutes. Then, the dyed vinyl polymer particles were dispersed with a mixture of ion-exchange water and methanol with a mixing ratio by weight of 30:70 and the dispersion was subjected to centrifugal sedimentation at 1000 rpm for 7 minutes. Thereafter, the dyed vinyl polymer particles were again dispersed with a mixture of ion-exchange water and methanol with a mixing ratio by weight of 1:1, and the dispersion was subjected to centrifugal sedimentation at 1000 rpm for 7 minutes. After the completion of the third centrifugal sedimentation, the dyed vinyl polymer particles were again dispersed with a mixture of ion-exchange water and methanol with a mixing ratio by weight of 1:1 so as to have a solid content was 30 wt. %.

3.54 g of a fluorine-containing compound of the following formula were dissolved in 350 g of a mixed solvent of ion-exchange water and methanol with a mixing ratio by weight of 1:1, so that a solution of the fluorine-containing compound at a concentration of 1 wt. % was obtained.

[Fluorine-containing compound]:

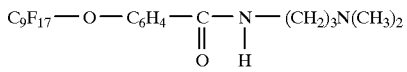

The thus obtained solution of the fluorine-containing compound was added to each dispersion of color toner particles in such a manner that the amount of the fluorine-containing compound was 0.03 wt. % of the solid content of the toner particles. The mixture was moderately stirred at 60 rpm at room temperature for one hour. After the toner particles were separated by filtration, the toner particles were air-dried, and dried under reduced pressure at 40° C. for 6 hours. Thus, toner particles according to the present invention were obtained.

50 g of the above prepared toner particles and 950 g of commercially available Iron powders "EFV200/300" (Trademark), made by Nippon Teppun Co., Ltd. were mixed and thoroughly stirred with the addition thereto of 10 g of finely-divided particles of silica. Thus, a two-component developer was prepared.

The thus obtained color developers were set in a commercially available copying apparatus "ARTAG8000 REALA" (Trademark), made by Ricoh Company, Ltd., to form the toner image, with the environmental conditions being changed to 10° C. and 15% RH, 23° C. and 60% RH, and 30° C. and 90% RH. The temperature of a heat-application roller in the image-fixing unit was set within the range of 100 to 180° C. for the image-fixing.

The gloss of the obtained toner image was visually inspected and the curling degree of the toner image fixed on an image-receiving medium was measured by the same method as in Example 1.

In addition, the image quality of the toner images obtained under the circumstances of high temperature and humidity, normal temperature and humidity, and low temperature and humidity were visually evaluated.

The results are shown in Table 8.

Example 19

The procedure for preparation of the yellow, magenta, cyan and black toner particles as in Example 18 was repeated except that the slurry (R) of the vinyl polymer particles used in Example 18 was replaced by the slurry (S).

Using the thus obtained yellow, magenta, cyan and black toner particles, two-component developers were prepared by the same method as in Example 18.

The thus obtained color developers were set in a commercially available copying apparatus "ARTAG8000 REALA" (Trademark), made by Ricoh Company, Ltd., to form the toner image, with the environmental conditions being changed to 10° C. and 15% RH, 23° C. and 60% RH, and 30° C. and 90% RH. The temperature of a heat-application roller in the image-fixing unit was set within the range of 100 to 180° C. for the image-fixing.

The gloss of the obtained toner image was visually inspected and the curling degree of the toner image fixed on an image-receiving medium was measured by the same method as in Example 1.

In addition, the image quality of the toner images obtained under the circumstances of high temperature and humidity, normal temperature and humidity, and low temperature and humidity were visually evaluated.

The results are shown in Table 8.

Comparative Example 12

The procedure for preparation of the yellow, magenta, cyan and black toner particles as in Example 18 was repeated except that the slurry (R) of the vinyl polymer particles used in Example 18 was replaced by the slurry (T).

Using the thus obtained yellow, magenta, cyan and black toner particles, two-component developers were prepared by the same method as in Example 18.

The thus obtained color developers were met in a commercially available copying apparatus "ARTAG8000 REALA" (Trademark), made by Ricoh Company,, Ltd., to form the toner image, with the environmental conditions being changed to 10° C. and 15% RH, 23° C. and 60% RH, and 30° C. and 90% RH. The temperature of a heat-application roller in the image-fixing unit was set within the range of 100 to 180° C. for the image-fixing.

The gloss of the obtained toner image was visually inspected and the curling degree of the toner image fixed on an image-receiving medium was measured by the same method as in Example 1.

In addition, the image quality of the toner images obtained under the circumstances of high temperature and humidity, normal temperature and humidity, and low temperature and humidity were visually evaluated.

The results are shown in Table 8.

TABLE 8

| | Slurry | Gloss of Toner Image | Degree of Curling | Image Quality (*) | Image Quality (**) | Image Quality (***) |
|---|---|---|---|---|---|---|
| Ex. 18 | (R) | good | 10 or more | good | good | good |
| Ex. 19 | (S) | good | 10 or more | good | good | good |
| Comp. Ex. 12 | (T) | good | 10 or more | toner deposition on background | good | toner deposition on background |

(*) Image formation was carried out under the circumstances of 10° C. and 15% RH.
(**) Image formation was carried out under the circumstances of 23° C. and 60% RH.
(***) Image formation was carried out under the circumstances of 30° C. and 90% RH.

In the toners obtained in Examples 18 and 19, the fluorine-containing compound in chemically bonded to a carboxylic acid and a sulfonic acid at the surface of the toner particles. As a result, sharp color images can be obtained even when the image formation is carried out under the circumstances of low temperature and humidity, or high temperature and humidity.

As previously explained, the binder resin for use in the toner of the present invention comprises a vinyl polymer prepared by polymerizing a plurality of different vinyl monomers, with a weight-average molecular weight (MW) of 30,000 or less, and a peak molecular weight (PMw) of 10,000 or less in the weight-average molecular weight, and the amount ratio of a vinyl polymer with a molecular weight of not less than the value of PMw×10 is in the range of 1 to 30 wt. % of the entire amount of the vinyl polymer. Therefore, the obtained toner image is provided with proper gloss and the curling of the toner image hardly takes place after image-fixing.

In addition, when part of the vinyl monomers is at least one of the previously mentioned vinyl monomer of formula (I) or (II) in the preparation of the vinyl polymer for the binder resin, or when part of the vinyl monomers is an ionic monomer to which part of the previously mentioned fluorine-containing compound of formula (III) is chemically bonded at the surface of the toner particles, sharp toner images can be obtained regardless of the environmental conditions such as the temperature and humidity. In particular, the manufacturing process of the toner can be made simple by omitting the washing step in the case where at least one of the previously mentioned vinyl monomer of formula (I) or (II) is used as the vinyl monomer in the preparation of the vinyl polymer for the binder resin.

Furthermore, when the ionic monomer used in the preparation of the vinyl polymer for the binder resin is the previously mentioned anionic monomer of formula (IV), the anionic monomer in fixed on the surface of the obtained toner particles steadily by the strong ionic bonding, so that the stability of the obtained toner does not change with time.

Japanese Patent Application No. 5-166472 filed on Jun. 11, 1993, Japanese Patent Application No. 5-271359 filed on Oct. 4, 1993, and Japanese Patent Application filed on Jun. 10, 1994 are hereby incorporated by reference.

What is claimed is:

1. A toner comprising toner particles for developing latent electrostatic images, each toner particle comprising a binder resin and a coloring agent, said binder resin consisting essentially of vinyl polymer prepared by polymerizing a plurality of different vinyl monomers, with a weight-average molecular weight (Mw) of 30,000 or less, and a peak molecular weight (PMw) of 10,000 or less in said weight-average molecular weight (Mw), with the amount ratio of a vinyl polymer with a molecular weight of not less than the value of α represented by formula (1) being in the range of 1 to 30 wt. % of the entire amount of said vinyl polymer:

$$\alpha = PMw \times 10 \quad (1).$$

2. The toner as claimed in claim 1, wherein part of said vinyl monomers in at least one of a vinyl monomer of formula (I) or a vinyl monomer of formula (II):

(I)

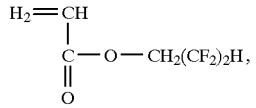

(II)

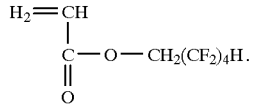

* * * * *